United States Patent [19]

Judge, Jr.

[11] 4,144,730

[45] Mar. 20, 1979

[54] PRODUCTION WORKPIECE STRAIGHTENING SYSTEM

[75] Inventor: Edward E. Judge, Jr., Lansing, Mich.

[73] Assignee: Industrial Metal Products Corporation, Lansing, Mich.

[21] Appl. No.: 875,384

[22] Filed: Feb. 6, 1978

[51] Int. Cl.[2] ..... B21D 3/16

[52] U.S. Cl. ..... 72/12; 72/389; 72/27

[58] Field of Search ..... 72/389, 12, 27, 9

[56] References Cited

U.S. PATENT DOCUMENTS 3,474,650 10/1969 Judge et al. ..... 72/12

3,948,076 4/1976 Eitel et al. ..... 72/12

*Primary Examiner*—Milton S. Mehr

[57] ABSTRACT

A production system for correcting distortions in a workpiece within tolerance requirements including for each distortion a gauge for determining direction and magnitude automatically employed to control corrective deflection beyond yield point under a program which increases with gauged distortion. Two specific applications of the system are disclosed for straightening axle shafts relative to a central axis and for straightening distorted caliper and steering arms of an automotive steering knuckle.

24 Claims, 32 Drawing Figures

FIG. 28

GENERAL SYSTEM

| OPERATION | EQUIPTMENT |
|---|---|
| LOAD WORKPIECE | STRAIGHTENING MACHINE |
| GAUGE DISTORTION | TRANSDUCER |
| STORE MAGNITUDE | PROGRAMABLE CONTROLLER |
| DEFLECT | HYDRAULIC RAM |
| LIMIT DEFLECTION | DISTORTION RESPONSIVE PROGRAM |

FIG. 29

SYSTEM APPLIED TO SHAFT

| OPERATION | EQUIPTMENT |
|---|---|
| LOAD SHAFT | DEAD CENTERS |
| GAUGE DISTORTION | ROTATE OVER TRANSDUCER |
| STORE HI-LOW MAGNITUDE | PROGRAMABLE CONTROLLER |
| POSITION HI POINT | CONTROLLED ROTATION |
| COMPUTE DISTORTION | HI-LOW DIFFERENCE |
| DEFLECT | HYDRAULIC RAM |
| LIMIT DEFLECTION | DISTORTION RESPONSIVE PROGRAM |

FIG. 30

SYSTEM APPLIED TO KNUCKLE

| OPERATION | EQUIPTMENT |
|---|---|
| LOAD KNUCKLE | STATION |
| CLAMP KNUCKLE | FIXTURE |
| GAUGE DISTORTION | TRANSDUCER |
| STORE ± MAGNITUDE | PROGRAMABLE CONTROLLER |
| DEFLECT | HYDRAULIC RAM |
| LIMIT DEFLECTION | DISTORTION RESPONSIVE PROGRAM |

(SAME FOR EACH STATION)

PRODUCTION WORKPIECE STRAIGHTENING SYSTEM

BACKGROUND OF THE INVENTION

Automatic shaft straightening has been previously accomplished by equipment such as shown in prior U.S. Pat. No. 3,474,650 issued on Oct. 28, 1969 wherein a shaft rotatably mounted on axial centers is gauged at three circumferentially spaced positions which cooperate to sense the direction of distortion with means to automatically rotate the shaft through the shortest distance to bring the high point to an uppermost position under a ram which thereupon deflects the shaft through an initial predetermined fixed stroke and incrementally increased strokes of predetermined fixed magnitude until, with automatic gauging after each stroke, straightness within tolerance is achieved. As many as twenty incremental steps could be programmed before finally achieving the straightened condition without overbending.

Irregular workpieces which are highly stressed in service are frequently manufactured as steel forgings subject to distortion during cooling or heat treatment which required correction by deflecting distorted projections beyond yield in preparation for finish machining or otherwise. A typical example is a forged steel steering knuckle for vehicle wheels which includes projecting caliper and steering arms for mechanical attachment of steering components. The arms include bosses which are drilled and milled in finish machining operations to accommodate attachment with precise geometrical relationship relative to the wheel spindle which is integrally formed in the steering knuckle. Each of such two projecting arms may require removal of distortion, referred to as "straightening", in either or both of two planes in order to provide adequate wall stock for respective finished machining operations. In some cases a third arm of the steering knuckle also requires straightening.

The prior art includes various means for gauging distortion and repeatedly progressively deflecting with predetermined fixed steps of initial and progressively greater amplitude until successive gauging indicates correction of distortion within tolerance; or trial and error deflection based on operator experience and manual controls. Such prior methods reflect time consumed in repetitious deflections in the same or opposite directions until tolerance is satisfied with corresponding restrictions in productive capacity.

SUMMARY OF THE PRESENT INVENTION

The present invention is directed to improve the productivity of prior straightening machines employing a controlled deflection stroke in a plane of production workpiece distortion by providing a variable corrective deflection stroke increasing with gauged distortion in accordance with a program determined empirically and directed toward achieving straightening within tolerance with a single deflection stroke. It is generally true of all metal workpieces having distortions arising through heat treatment or otherwise, which have the characteristic of yielding under a sufficient bending moment deflection with springback to a straightening condition, that a greater deflection beyond the neutral position of a straight part is required with greater magnitude of initial distortion. Thus, a workpiece which is only slightly distorted may be straightened by deflection only slightly beyond the initial yield point deflection of a straight part involving tensile and/or compressive yield at only the outermost fibres whereas a workpiece having greater initial distortion will require yield to a greater depth from the surface which, being closer to the neutral axis, will involve a greater deflection in order to achieve straightness upon springback.

This characteristic is employed in the present system as a basis for programmed deflection increasing with the magnitude of initial distortion. In implementing this approach the system programs an initial corrective deflection stroke derived as a combination of a standard deflection equal to the initial minimum yield point deflection for a straight part plus an added deflection based on a ratio of gauged distortion established empirically to approach a fully straightened condition with a single deflection stroke.

As applied to shaft straightening the present invention provides an improved method and apparatus in several respects. A single gauge head is employed at each of as many positions along the length of the shaft as may be required with a corresponding deflection ram for each position which may be directly opposite or longitudinally spaced from the gauge head depending on the particular shaft and critical surfaces relative to ram and reaction points. Upon a single initial revolution of the shaft about axial centers, the gauge head for a predetermined initial position senses the magnitude of distortion; high and low gauge readings are stored in a controller; a further rotation of the shaft is stopped when the gauge head indicates that the high point has reached uppermost position in alignment with the ram; a program which varies with maximum distortion determined by the difference between high and low gauge readings produces an initial ram stroke variable in accordance with such program and established to produce a straightened condition for the shaft at the gauged position potentially within tolerance with a single stroke. Programmed incremental steps are included if gauging upon release of ram deflection indicates remaining out of tolerance condition. However, the requirement for additional ram strokes compared to the previous system is substantially reduced by producing an initial and any subsequent stroke of a magnitude variably responsive to initial and subsequently gauged distortion, the magnitude of any corrective deflection stroke increasing with the magnitude of gauged distortion.

In predetermined order a similar straightening sequence is repeated at each of the additional shaft locations as may be required followed by a final rotational check to verify straightening within tolerance at all gauged positions. Apparatus for performing the sequence of straightening operations includes a gauge probe at each longitudinal position for actuating a variable transducer providing a null balance voltage signal at zero part deformation and variable plus or minus analog voltage signals on either side thereof proportional to shaft distortion and an amplifier coupled with a digital controller which converts and stores high and low values of transducer analog voltage signals produced by the gauge head. The gauges are employed in determining initial and residual values of distortion; also in controlling the limit of deflection produced by the associated ram in accordance with the controller program.

For gauging purposes each shaft is supported on dead centers, in turn supported on stationary V blocks, for rotation during gauging and high point orientation. Such centers are deflectable to axially spaced anvil support positions for the workpiece shaft located at axially spaced positions relative to deflecting rams as required to produce desired bending moments optimum for effecting straightening within tolerance with a minimum number of rams. A floating drive independent of the centers is provided to rotate the workpiece shaft as required.

All straightening rams are pivotally mounted on a common cylindrical actuating shaft along which the respective ram heads may be adjustably positioned as required for the particular shaft to be straightened. Provision is made to swing each ram head to clearance position for loading and unloading of shafts, preferably accomplished by automatic transfer means, or to an inactive position when not involved in a particular shaft deflection.

As applied to correcting distorted extensions of irregular workpieces, the present system is directed to position and clamp the workpiece; automatically measure the direction and magnitude of distortion in each plane for which correction may be required; employ a programmed corrective deflection varying with the magnitude of distortion in order to achieve correction within tolerance with a single deflection in most cases, and including a sub-program for further corrective deflection in any unusual case where a single deflection is not adequate.

The programs may be refined emperically with experience so that notwithstanding commercial variations in size, material specification and heat treatment, tolerance requirements may be met with a minimum number of corrective deflections and with greatly improved productivity over previous systems.

In general, hydraulically actuated rigid mechanical clamping in an accurate locating fixture is employed with gauge heads positioned to register on critical surfaces of the workpiece projections and adapted through displacement from a nominal position adjusted relative to a master workpiece to produce through a variable transducer a plus or minus voltage signal proportional to displacement and responsive to the direction of distortion from the nominal "null balance" position of the gauge head. Hydraulically actuated rams are adapted to deflect the workpiece arms while gauge heads remain in registration so that any programmed deflection beyond yield may be sensed and employed to limit the stroke of hydraulic actuation followed by ram release, springback and further programmed deflection if the gauge head continues to indicate an out-of-tolerance condition. A digital controller is employed for multiple gauge input control capable of storing multiple programs responsive to each gauge head employed in monitoring the various straightening operations, with a suitable converter employed to transpose the analog voltage signal of each variable transducer to digital readings which may be stored in a controller and used in carrying out programmed operations.

Where more than one straightening station is employed apparatus for automatic workpiece transfer renders the entire system including loading and unloading of workpieces adaptable to a single workman operation.

BRIEF DESCRIPTION OF THE DRAWINGS

FIG. 28 is a schematic box diagram illustrating in general the operational steps and equipment of the present straightening system;

FIG. 29 is a similar schematic illustration of the system applied to shaft straightening;

FIG. 30 is a similar schematic illustration of the system applied to irregular workpiece extensions comprising an automotive steering knuckle.

STRAIGHTENING SYSTEM APPLIED TO STEERING KNUCKLE

Figure 1:
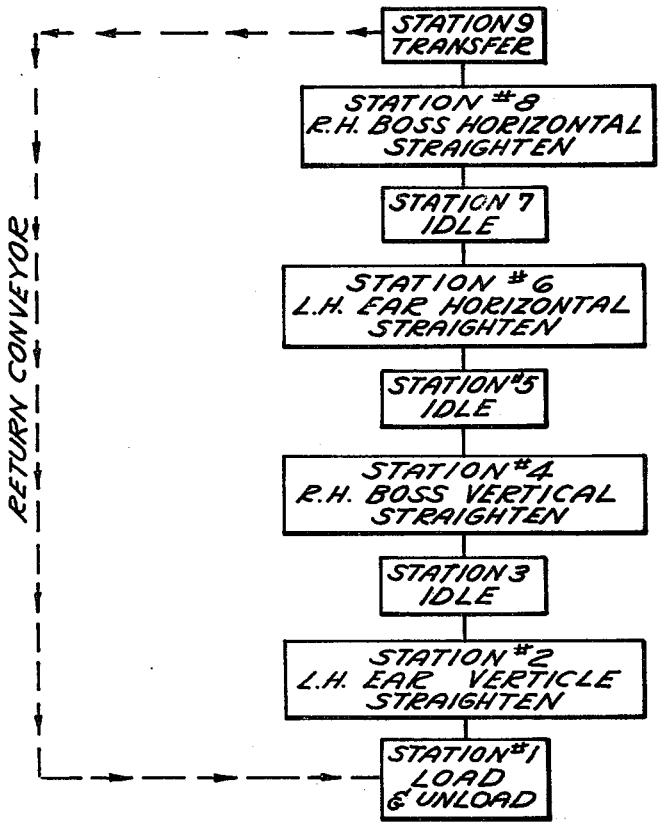
FIG. 1 is a schematic diagram of system stations for straightening a typical workpiece comprising a steering knuckle for an automotive vehicle.
Figure 2:
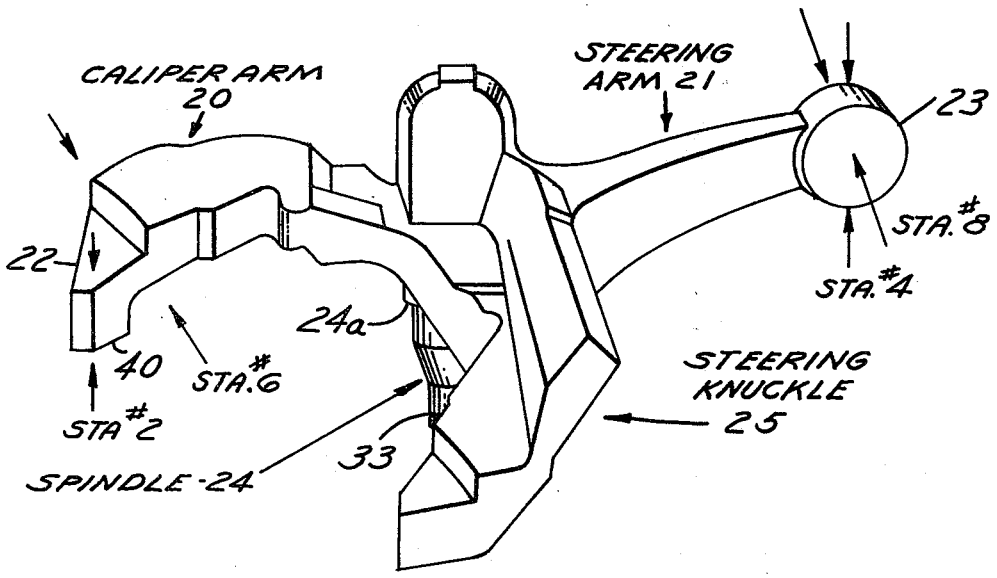
FIG. 2 is a perspective view of the steering knuckle to be straightened in the disclosed system.
Figure 3:
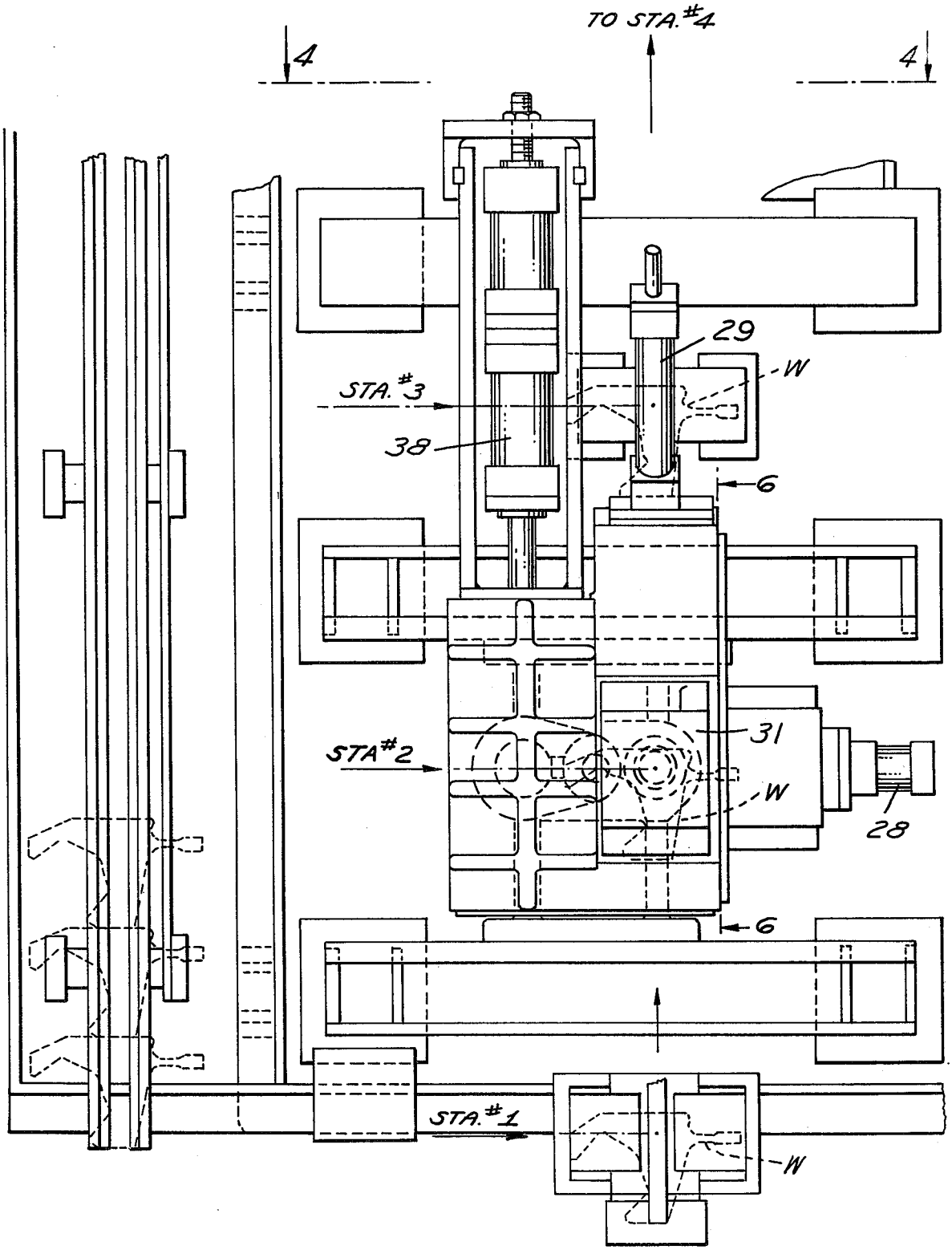
FIG. 3 is a plan view showing the first three stations.
Figure 3A:
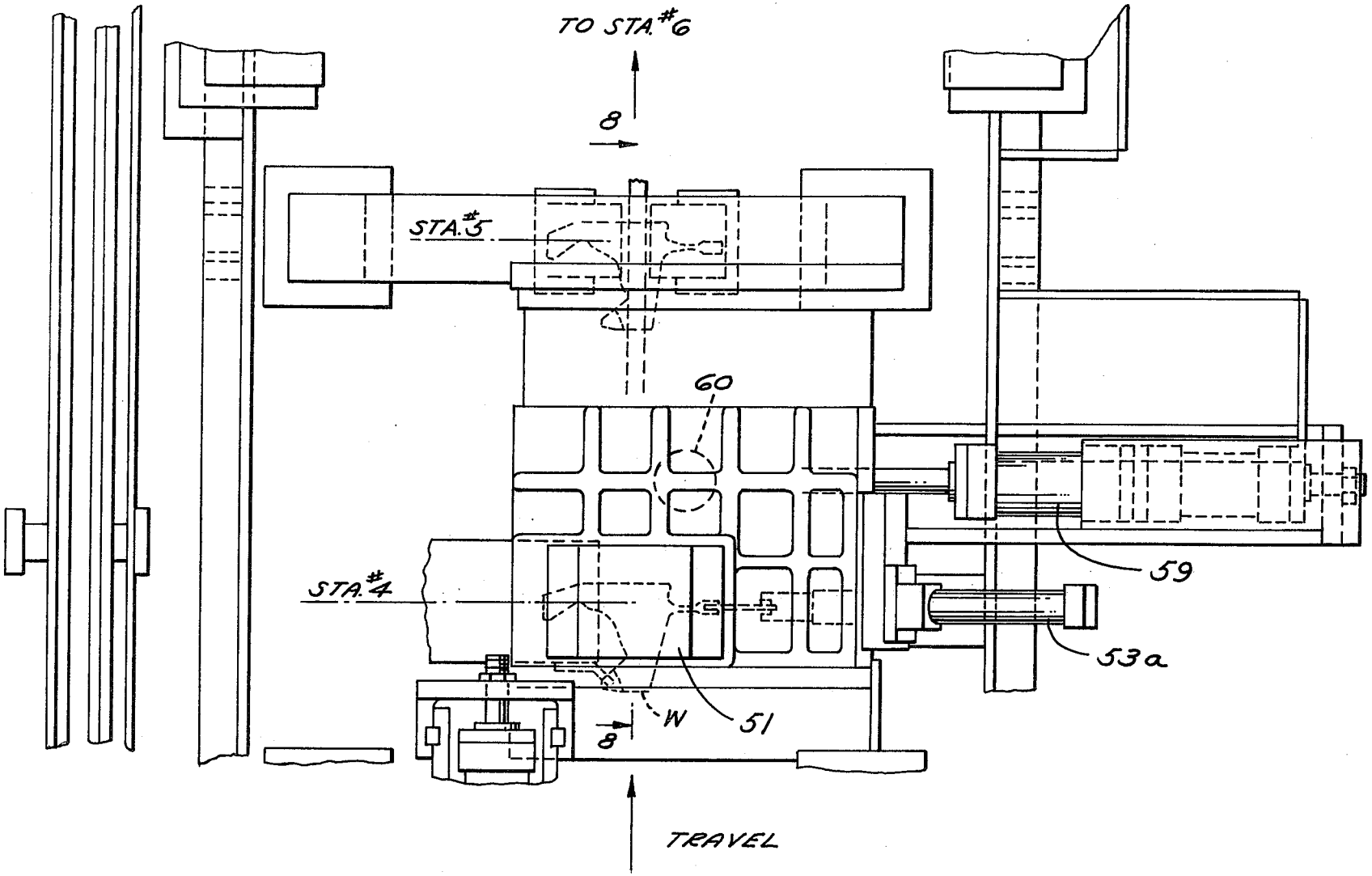
FIG. 3*a* is a plan view showing stations four and five.
Figure 3B:
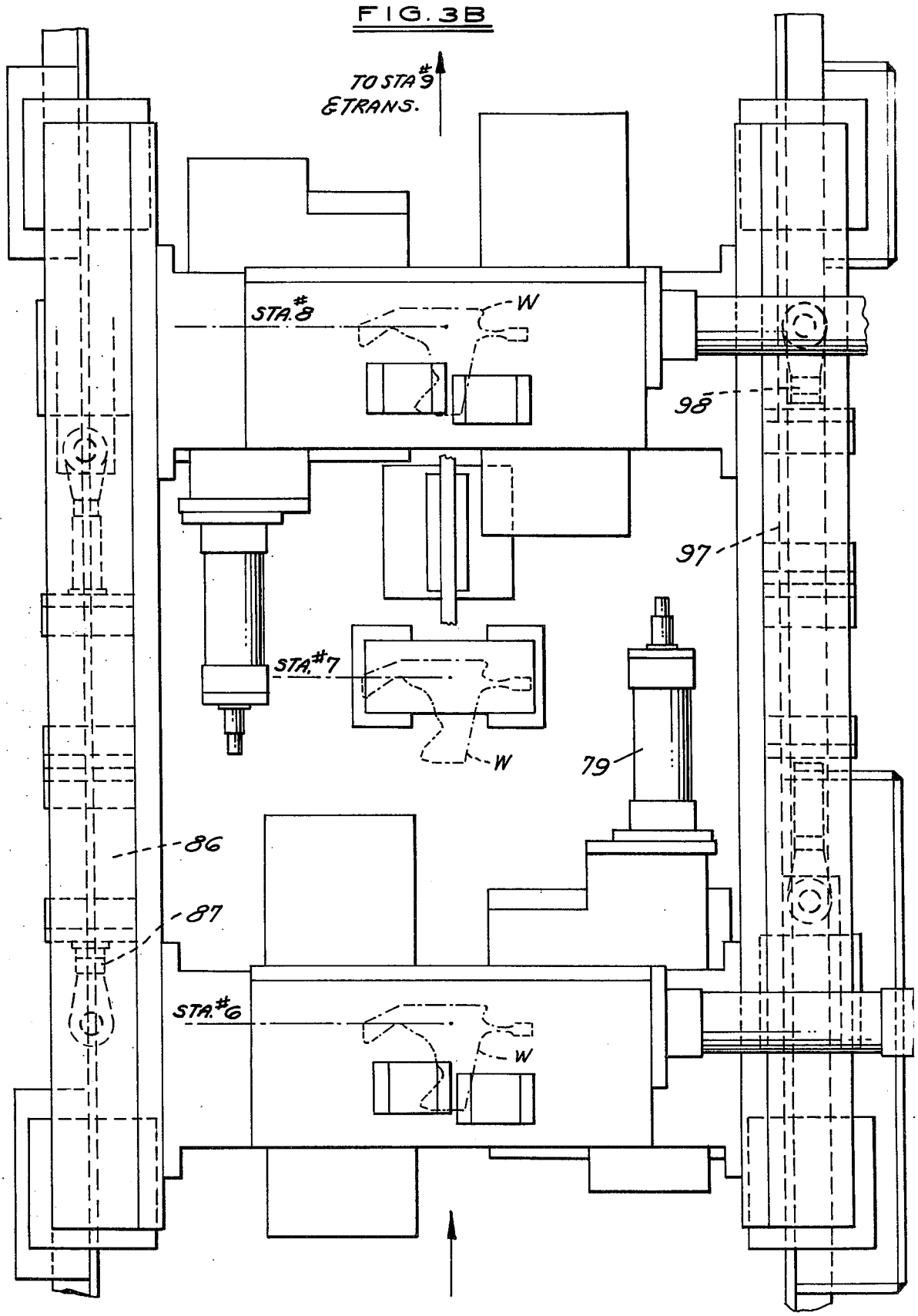
FIG. 3*b* is a plan view showing stations six, seven and eight.

Referring to FIGS. 1 and 2 the particular production workpiece involved is a steering knuckle for the front wheel of an automotive vehicle. The knuckle has three arms each of two of which requires straightening in two normal planes to remove distortion in order to bring machinable surfaces of the arms within manufacturing tolerances. Such arms comprise a caliper arm 20 which is straightened in a vertical direction in station No. 2 and a horizontal direction in station No. 6 and a steering arm 21 straightened in vertical direction in station No. 4 and a horizontal direction in station No. 8. In the caliper arm 20 the particular element to be machined with reference to which gauging takes place at the respective stations No. 2 and No. 6 is a left hand ear 22 while the element of the steering arm is a right hand boss 23.

The total system includes nine stations and a return conveyor which, as indicated in the schematic diagram of FIG. 1 includes a first station where the workpieces are loaded and unloaded, a second station for straightening the left hand ear in a vertical direction, an idle station No. 3, a station No. 4 for straightening the right hand boss in a vertical direction, an idle station No. 5, a station No. 6 for straightening the left hand ear in a horizontal direction, an idle station No. 7, a station No. 8 for straightening the right hand boss in a horizontal direction, a transfer station No. 9 and a return conveyor for bringing the straightened workpiece back to unload at station No. 1. Provision for automatic transfer between respective stations is included and at each straightening station automatic clamping mechanism accurately and rigidly positions the workpiece in a fixture with reference to its spindle 24, spindle shoulder 24*a* and a main body arm 25 followed by automatic gauging and straightening as required.

Figure 6:
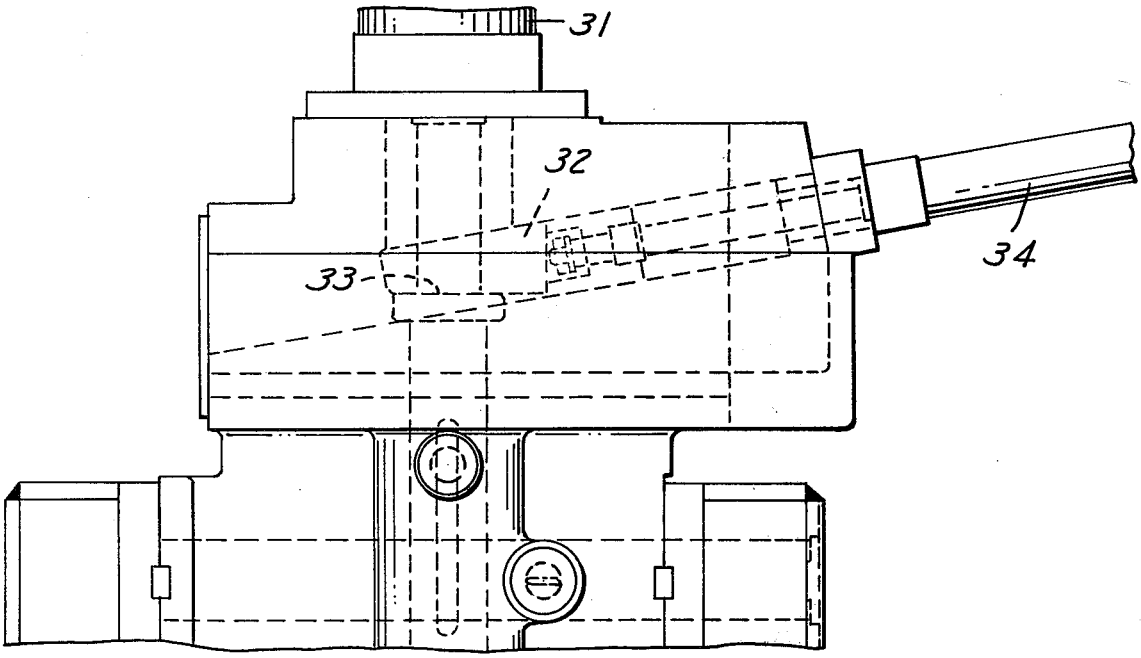
FIG. 6 is a fragmentary side elevation of station No. 2 taken along the line 6—6 of FIG. 3.
Figure 7:
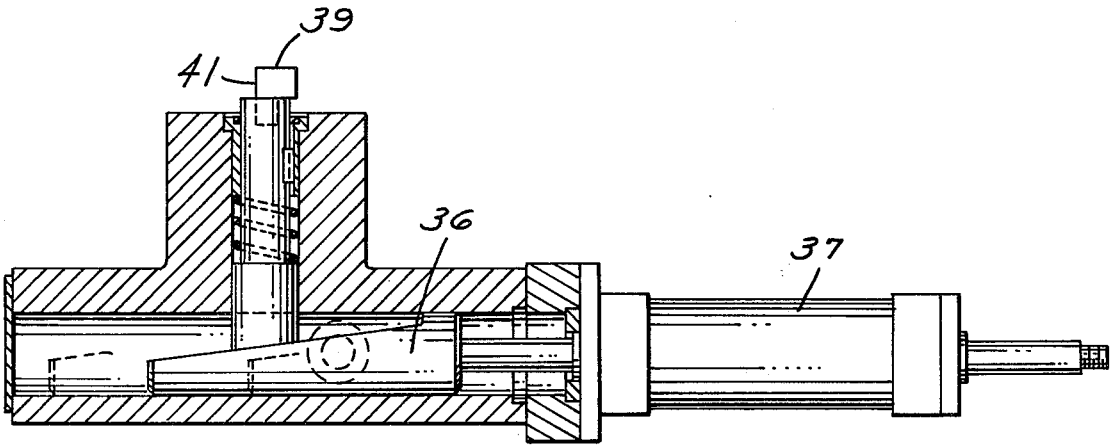
FIG. 7 is a sectional side view taken along the line 7—7 of FIG. 5.
Figure 8:
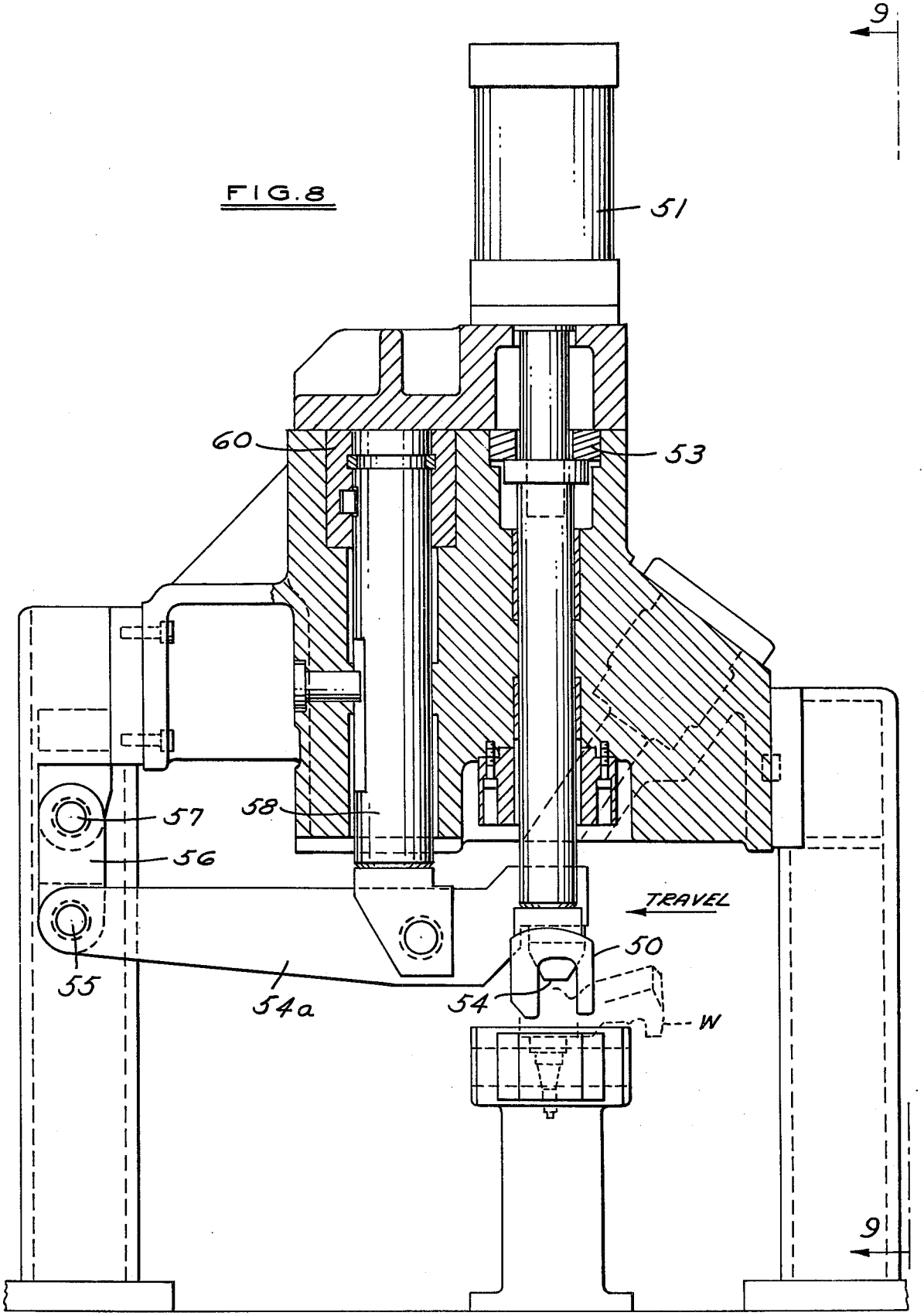
FIG. 8 is a sectional side elevation of station No. 4 taken along the line 8—8 of FIG. 3*a;*

With reference to FIGS. 3 and 4–7 illustrating station No. 2 and the clamping and straightening mechanism associated therewith it will be seen that the workpiece "W" shown in dotted line is rigidly clamped by a three jaw main clamp 29 forcing the spindle shoulder against horizontal support surfaces 30 actuated by hydraulic cylinder 31, a spindle clamp comprising a stationary jaw 26 and movable V-jaw 26*a* actuated by hydraulic cylinder 28, and a wedge clamp 32 engaging shoulder 33 actuated by hydraulic cylinder 34 as shown in FIG. 6 to retain clamp 29 against high straightening loads. The boss 23 of the workpiece is located between pads 27 while the projecting arm 25 of the workpiece is located by a fixed bracket 34 preparatory to clamping.

Figure 4:
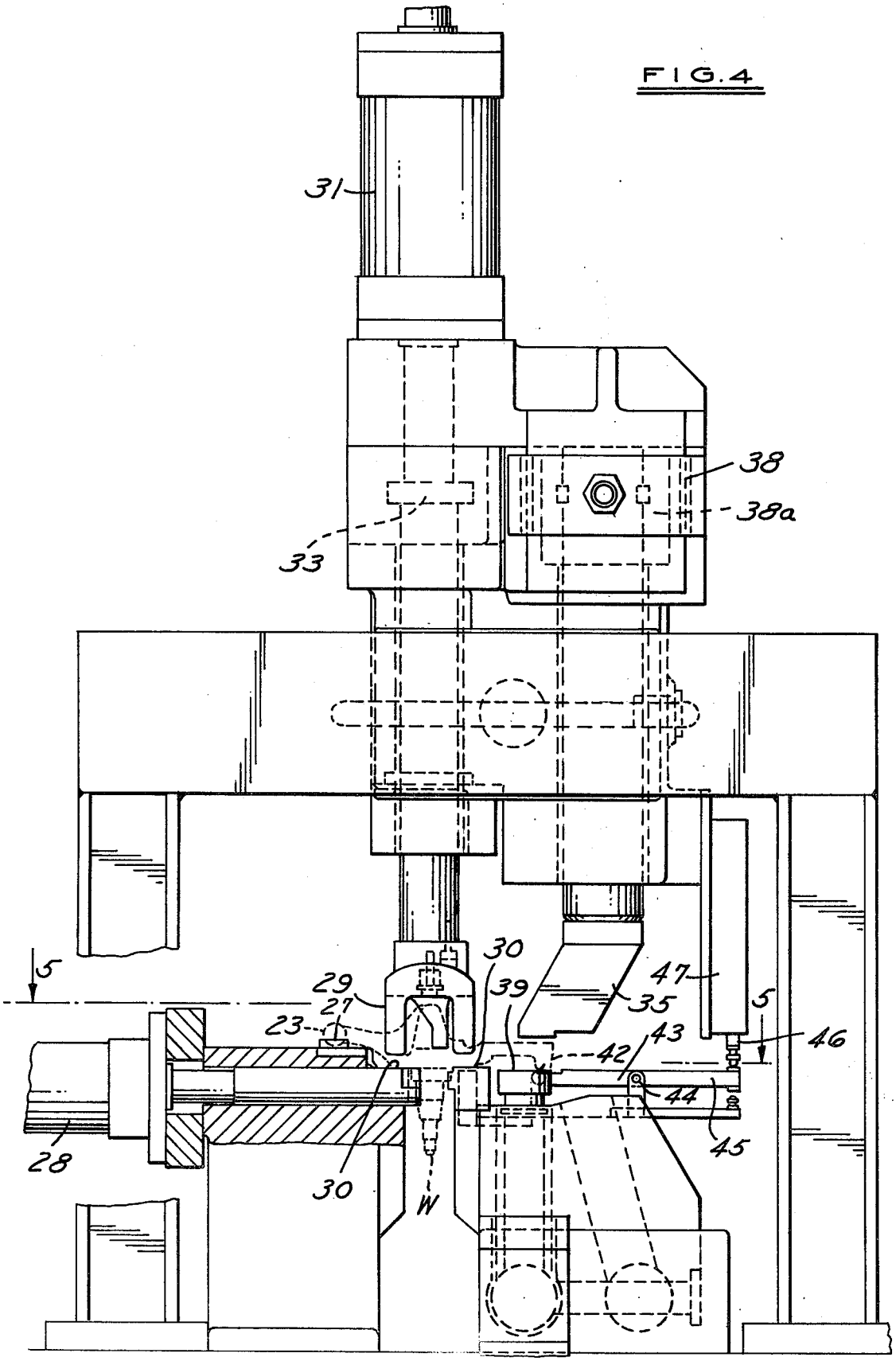
FIG. 4 is an end elevation showing station No. 2 taken along the line 4—4 of FIG. 3.
Figure 5:
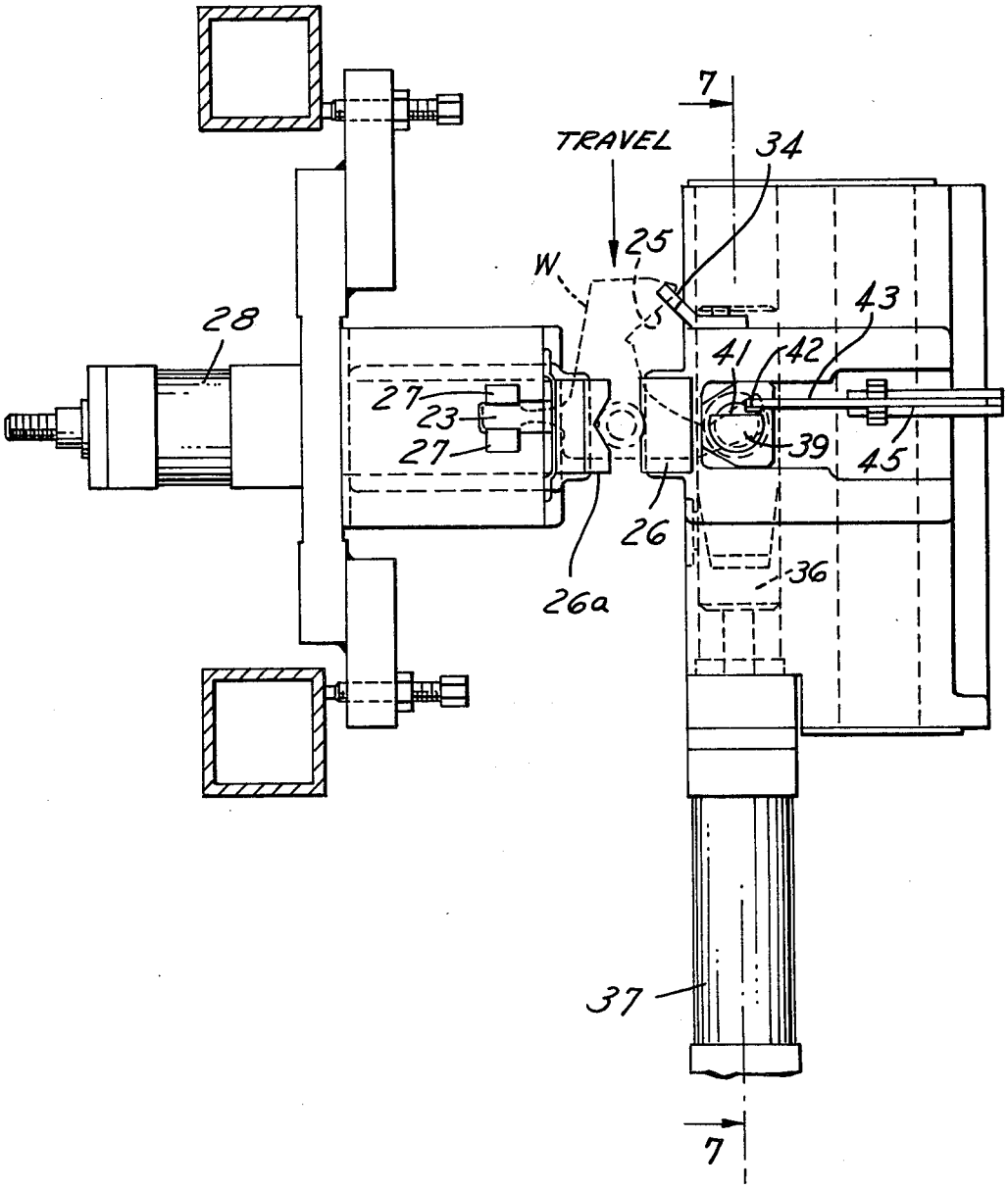
FIG. 5 is a plan view of station No. 2 taken along the line 5—5 of FIG. 4.

Deflection of the caliper arm in a vertically downward direction is effected by a ram 35 as shown in FIG. 4 actuated in two stages by a double horizontal cylinder 38 (see FIG. 3) operating through cross slide 38*a* while the raising of such caliper arm is effected by a wedge engaged piston 36, actuated by horizontal hydraulic cylinder 37. The upper end of the piston 36 is provided with an engagement pad 39 for contacting the lower surface 40 (see FIG. 2) of the workpiece ear 22 and is relieved at 41 (see FIG. 5) to accommodate the gauge head 42 at the end of the arm 43 pivoted at 44 having an extension 45 adapted to actuate the plunger 46 of a transducer 47 adapted to provide a plus or minus voltage signal proportional to displacement on either side of a null-balance neutral point corresponding to the nominally correct position of the ear adjusted relative to a master part used in set-up. With this arrangement the gauge head 42 is able to follow the caliper ear gauge surface 40 during deflection providing a continuous analog voltage signal proportional to deflection and thereby monitor the extent of deflection in accordance with the control program hereinafter described which is set-up and adjusted emperically with test parts to determine deflection required relative to initial distortion to obtain straightening in a single stroke or with minimum number of strokes. The program includes backbending if over bending takes place on the initial stroke or if opposite initial distortion is involved and the program is varied for successive straightening or backbending strokes on the same part.

With reference to FIGS. 3*a*, 8, 9, 10 and 11 similar clamping and gauging apparatus to that in station No. 2 includes a main three jaw clamp 50 actuated by hydraulic cylinder 51, a spindle clamp applied by cylinder 52, and a wedge 53 actuated by hydraulic cylinder 53*a* for holding the three jaw clamp 50 as in the case of station No. 2. Vertical displacement of the steering arm is effected in a downward direction by a boss engaging head 54 at the end of an arm 54*a* pivoted at 55 through a link 56 to a fixed pivot 57. The arm 54 is actuated by a piston 58 and horizontal cylinder 59 through a tapered cross slide 60.

Figure 9:
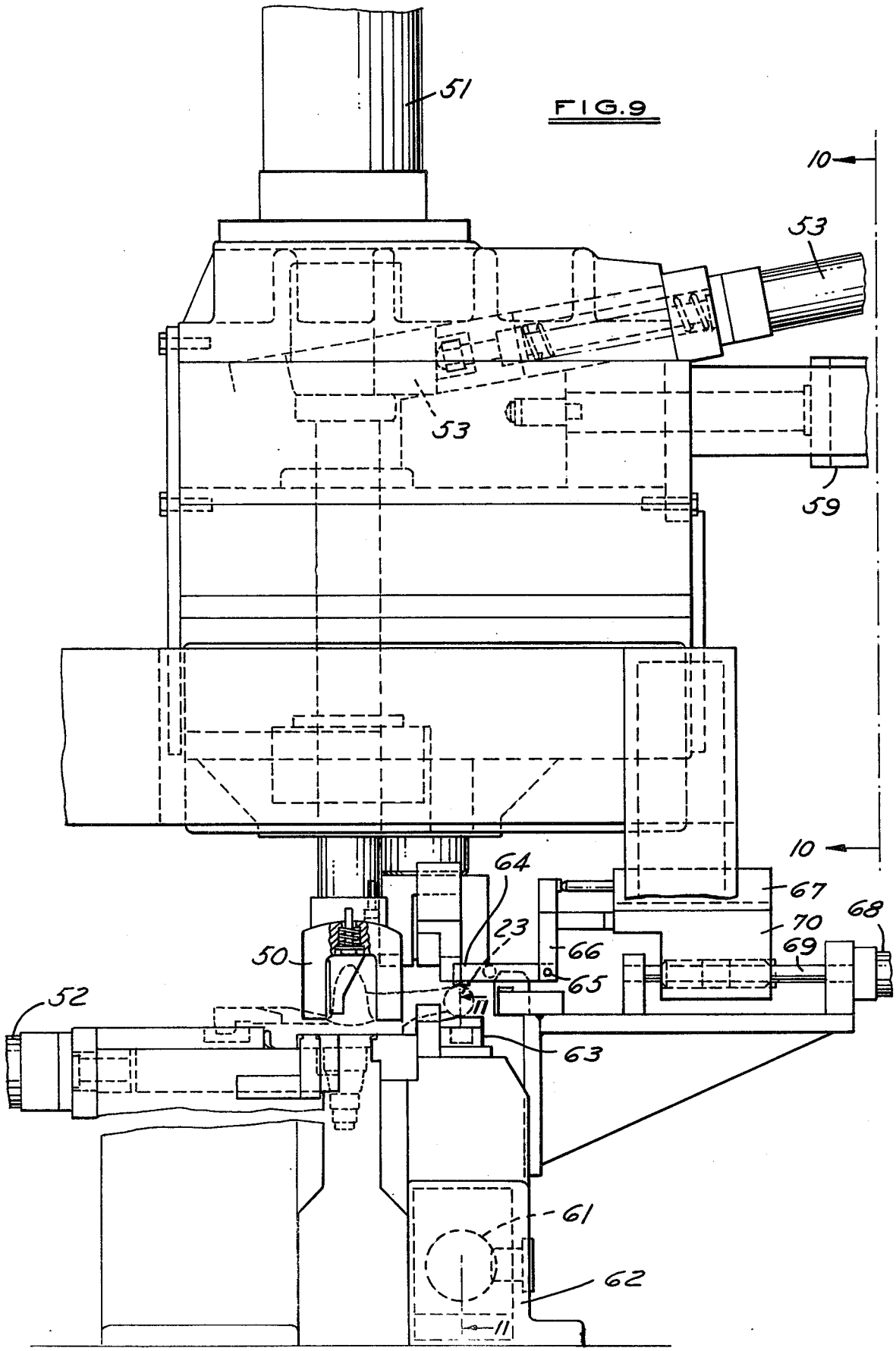
FIG. 9 is an end elevation of station No. 4 taken along the line 9—9 of FIG. 8.
Figure 10:
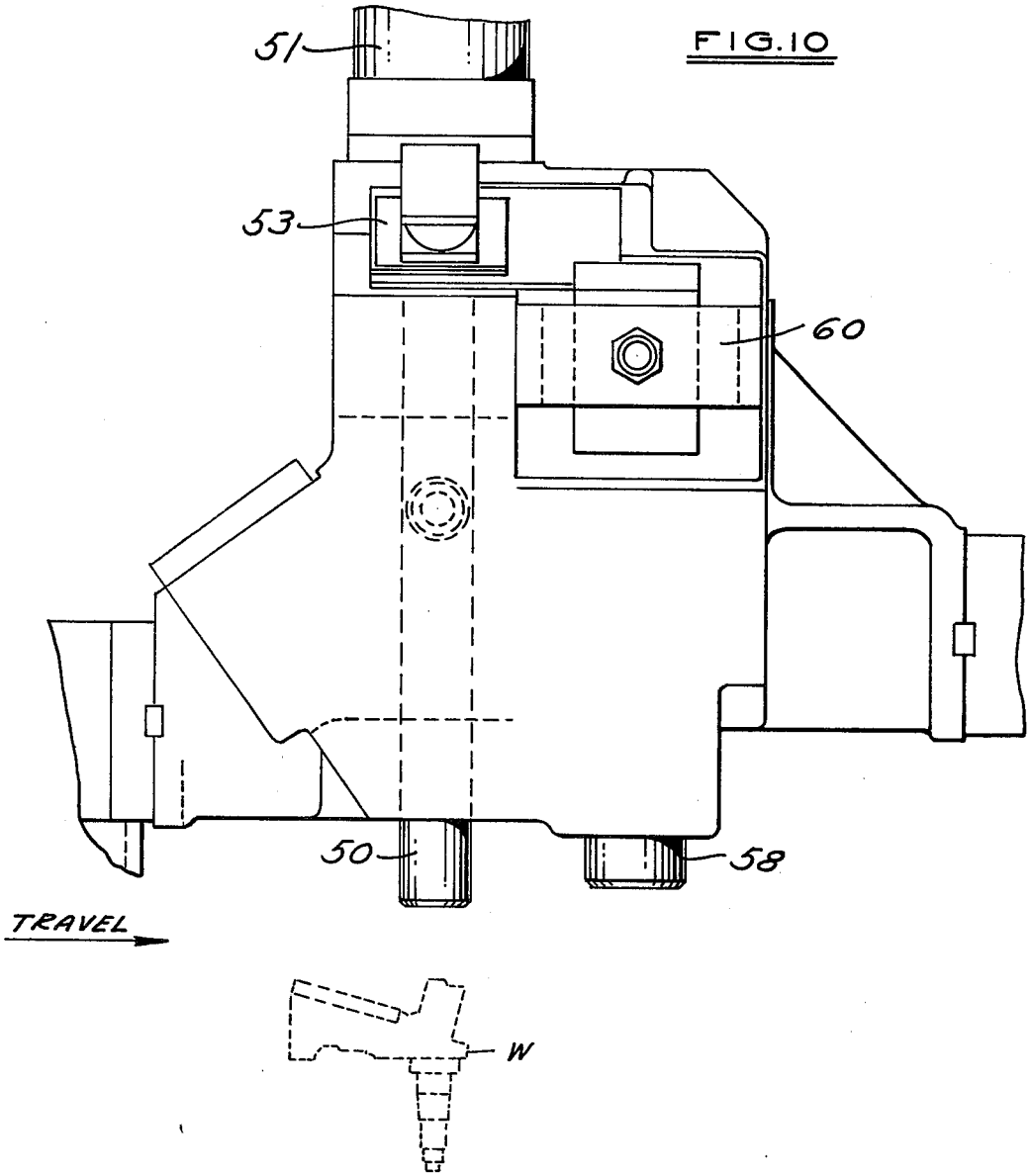
FIG. 10 is a fragmentary side elevation taken along the line 10—10 of FIG. 9.
Figure 11:
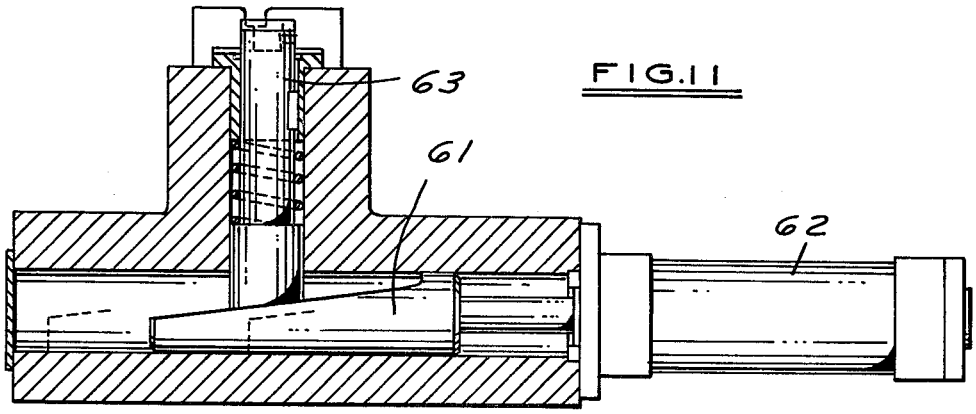
FIG. 11 is a fragmentary sectional side view taken along the line 11—11 of FIG. 9.

As best shown in FIGS. 9 and 11, backbending in an upward direction is effected by wedge 61 actuated by hydraulic cylinder 62 moving piston 63 to engage the lower surface of the boss 23. The gauge head 64 pivoted at 65 follows deflection of the boss in either direction and through bellcrank arm 66 actuates a transducer 67. Prior to and after the gauging operation, the gauge head is removed to a clearance position by cylinder 68 and piston rod 69 through a slide mounting 70 for the transducer.

Figures 13, 14:
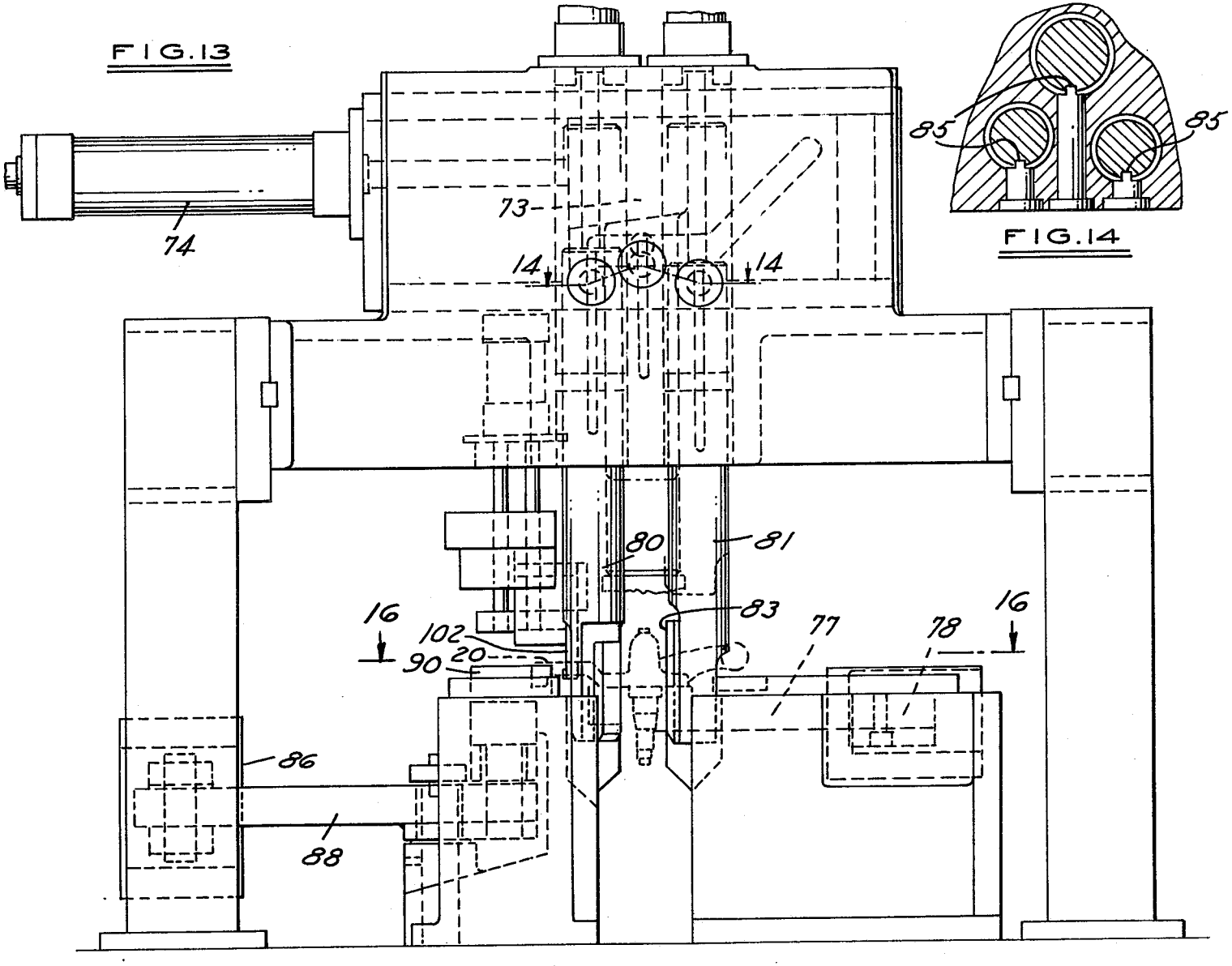
FIG. 13 is an end elevation of station No. 6 taken along the line 13—13 of FIG. 12.
FIG. 14 is a fragmentary sectional view taken along the line 14—14 of FIG. 13.
Figure 15:
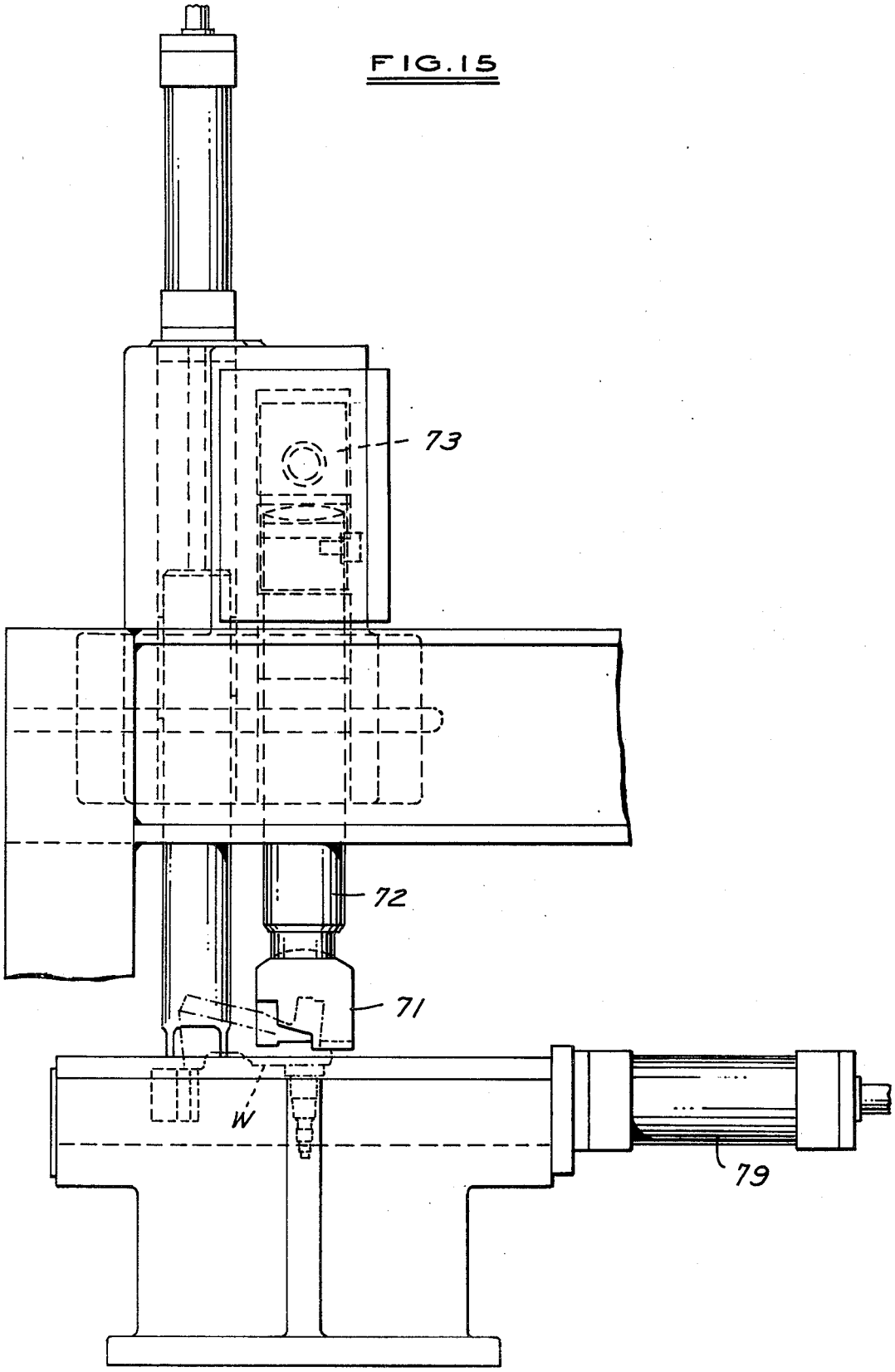
FIG. 15 is a side elevation of station No. 6 taken along the line 15—15 of FIG. 12.
Figure 16:
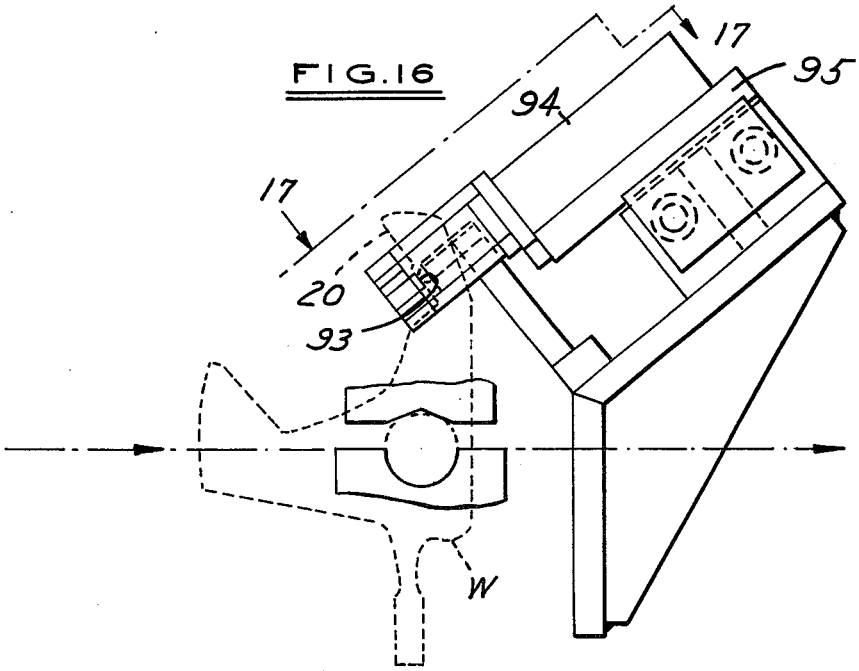
FIG. 16 is a fragmentary plan view of station No. 6 taken along the line 16—16 of FIG. 13.

With reference to FIGS. 3*b* and 12 through 18 station No. 6 for straightening the caliper arm 20 in a horizontal direction includes a main three jaw clamp 71 actuated by a vertical piston 72 engaged by cross slide 73 actuated by horizontal hydraulic cylinder 74, a spindle clamp provided by fixed jaw 75 movable jaw 76, piston 77 engaged by wedge 78 actuated by hydraulic cylinder 79, and a main arm wedge clamp comprising a pair of retractable pistons 80 and 81 having respective arm engaging clamp surfaces 82, 83 for retaining the arm 25 against horizontal movement in either direction. Proper orientation of the pistons 80 and 81 as well as 72 is maintained in each by a slot 84 engaged by a fixed key 85 as best shown in FIGS. 13 and 14.

Straightening action in either horizontal direction is effected by a double acting hydraulic cylinder 86, piston rod 87 arm 88 pivoted at 89 having jaws 90 for engaging either side of the caliper arm 20.

Figure 17:
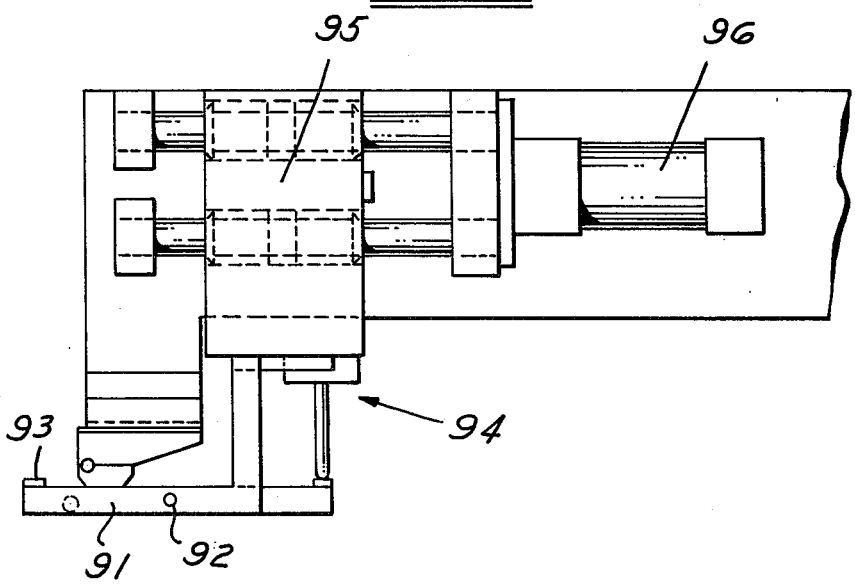
FIG. 17 is a fragmentary view taken along the line 17—17 of FIG. 16.
Figure 18:
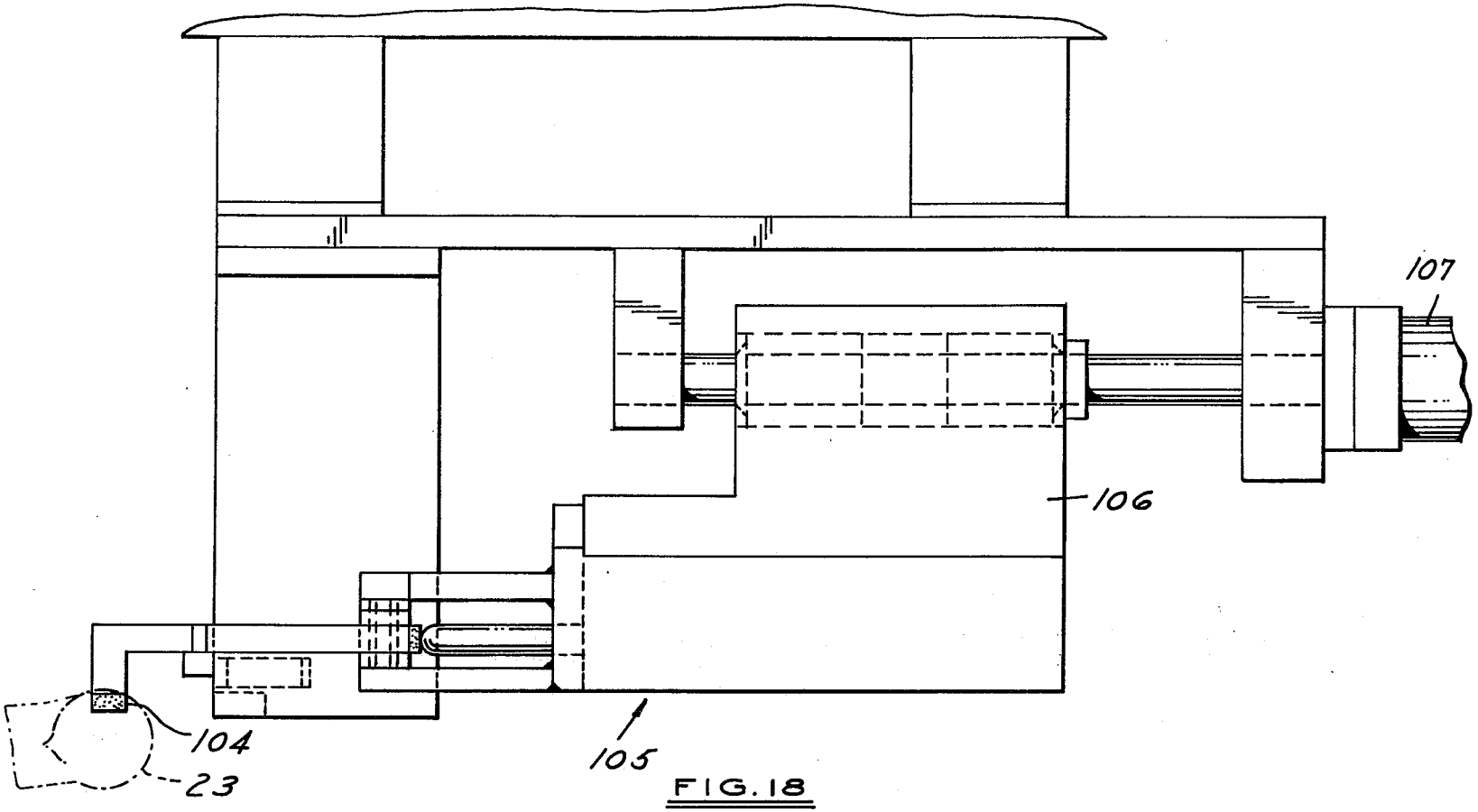
FIG. 18 is a fragmentary end view taken along the line 18—18 of FIG. 12.

With reference to FIGS. 13, 17 and 18, gauging at station No. 6 takes place through a bellcrank gauge arm 91 pivoted at 92 having a contact face 93 engaging one side of the caliper arm 20 and actuating a transducer 94, the gauge being retractable for workpiece loading and unloading through slide 95 operated by piston cylinder 96.

Figure 12:
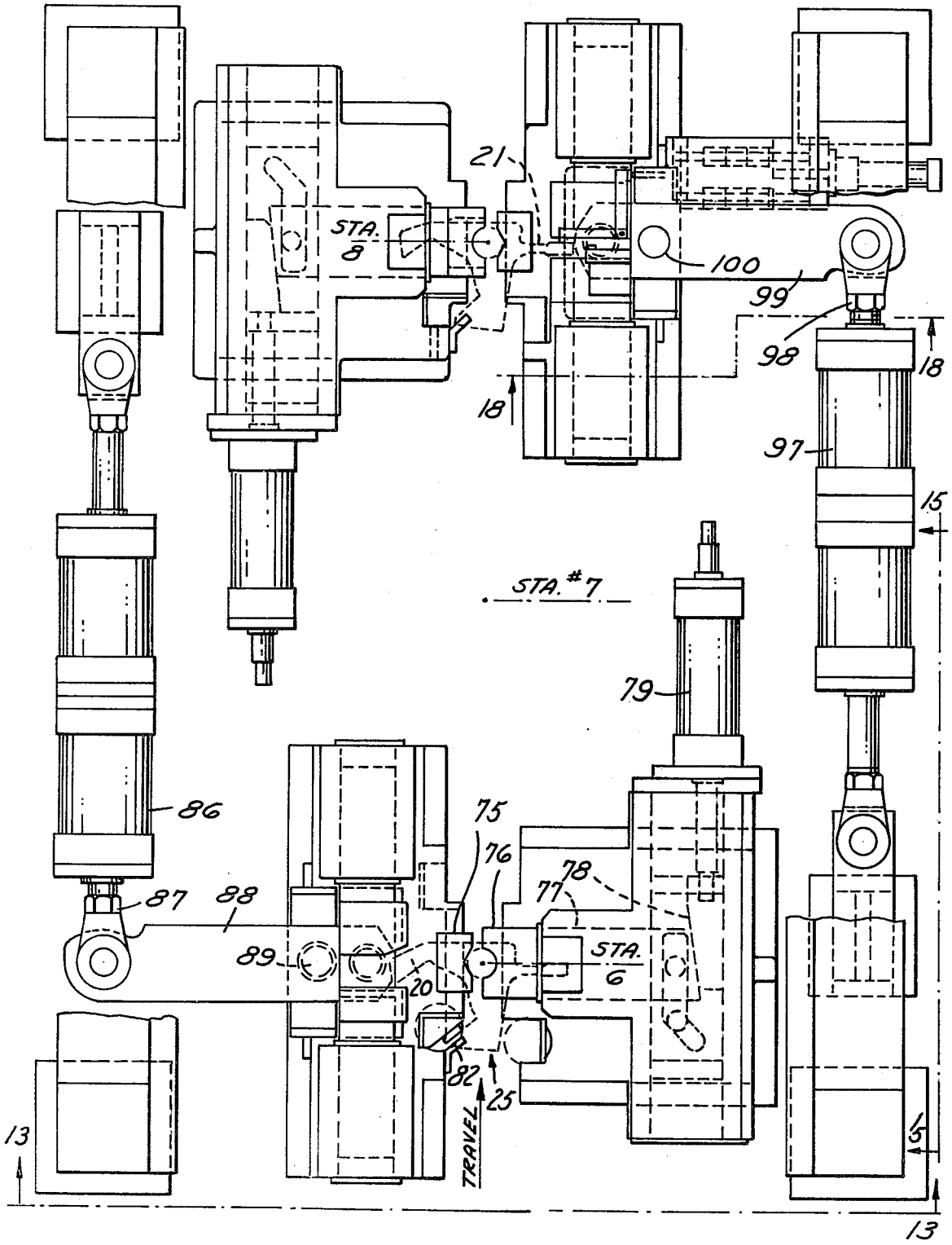
FIG. 12 is a plan view showing stations six and eight with portions of the superstructure omitted for clarity.

At station No. 8 the workpiece is similarly clamped and the steering arm 21 is similarly straightened by double acting hydraulic cylinder 97, piston rod 98, arm 99 pivoted at 100 and jaws 101 engaging either side of the boss 23. As best shown in FIGS. 12 and 18 the bellcrank gauge arm 102 pivoted at 103 has a contact face 104 engaging one side of the boss 23 and actuates a transducer 105, the gauge being retractable for loading and unloading through slide 106 operated by piston cylinder 107.

STRAIGHTENING SYSTEM APPLIED TO AXLE SHAFT

Figure 19:
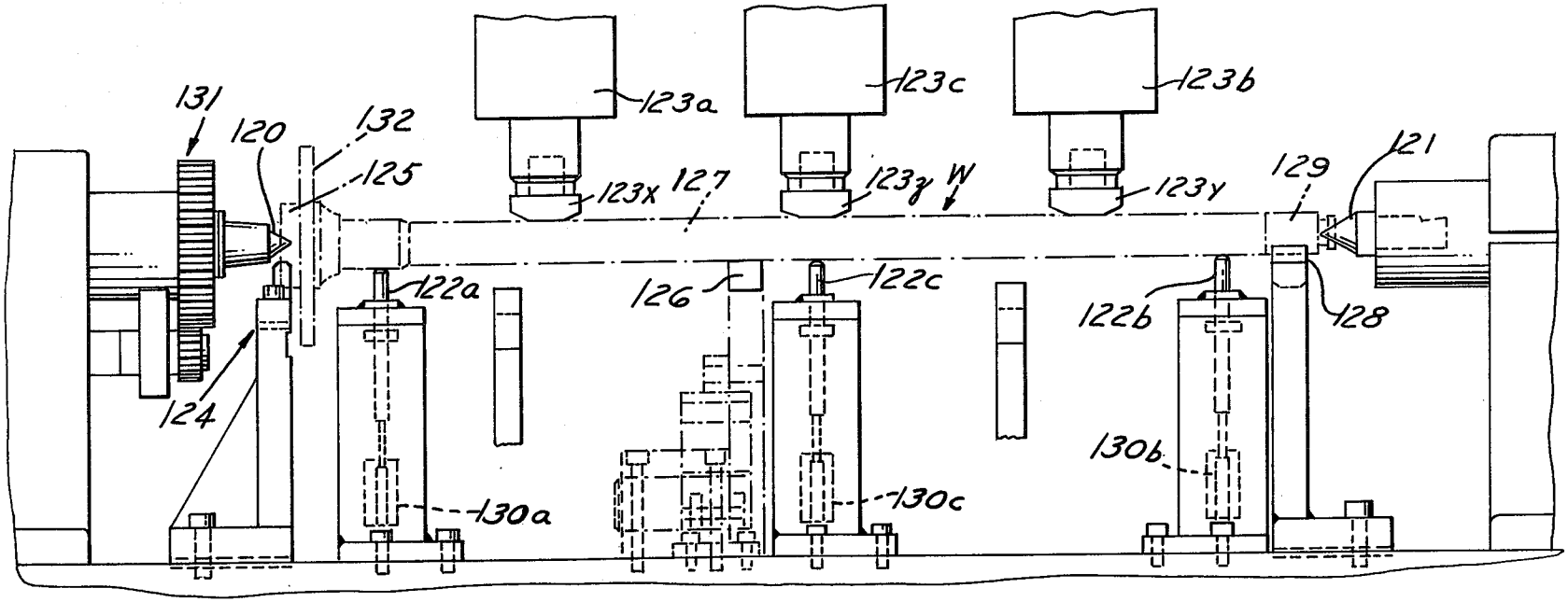
FIG. 19 is a side elevation of the present workpiece straightening system applied to shaft straightening.

With reference to FIG. 19 the illustrated straightening machine includes dead centers 120 and 121 for engaging the respective ends of a workpiece shaft "W", in the present case comprising an axle shaft for an automotive vehicle. Gauges 122*a*, 122*b* and 122*c* contact respectively critical surfaces at either end of the workpiece as well as the central position for detecting excessive vibration producing bow. Multiple ram heads 123*a*, 123*b* and 123*c* are provided to engage axially spaced portions of the workpiece and through individually (or simultaneously) actuated vertical strokes to effect required deflection of the workpiece for straightening. A fixed support anvil 124 is provided to support the flange end 125 of the workpiece and a retractable anvil 126 to support a central portion 127 of the workpiece during individual straightening actuation of the ram 123*a*. A fixed anvil 128 is provided to support the other end 129 of the axle shaft along with the retractable anvil 126 during individual straightening deflection of the ram 123*b*. The end anvils 124 and 128 serve to support the axle shaft with the center anvil 126 retracted during individual straightening actuation of the center ram 123*c*. It will be noted that gauges 122*a* and 122*b* are located at critical bearing locations for the shaft axially spaced from the respective ram heads 123*a* and 123*b* which are adjustably located at optimum positions for producing straightening bending moments for bringing the gauged surfaces into axial alignment with the centers of the shaft engaged by the dead centers 120, 121.

As best shown in FIGS. 19, 25, 26 and 27, each of the gauges 122*a*, 122*b* and 122*c* is adapted to directly actuate a variable transducer 130*a*, 130*b* and 130*c* for producing an electrical voltage signal preferably on either side of a central null balance position adjustable relative to a master workpiece having nominally correct gauge surfaces. In such case voltage signal will be plus or minus on opposite sides of the null balance position and proportional in magnitude to displacement from such neutral position. As later explained in more detail the analog voltage signal of each transudcer is amplified, converted and stored in a digital controller during a single rotation of the workpiece shaft on the dead centers 120 and 121 with the deflecting rams 123*a*, 123*b* and 123*c* retracted. The high and low points of each gauge are compared to determine total eccentric distortion of the gauge surface relative to shaft centers and if any is out of tolerance a corresponding maximum gauged signal is used during a partial second revolution of the workpiece shaft to bring the high point of the shaft to an uppermost position for straightening. In the case of sequential ram actuation, priority is given to the respective gauges as found emperically to provide a preferred order of straightening. Deflections by the respective rams in the case of the axle shaft disclosed is in the order 123*a*, 123*b* and 123*c*.

Figure 21:
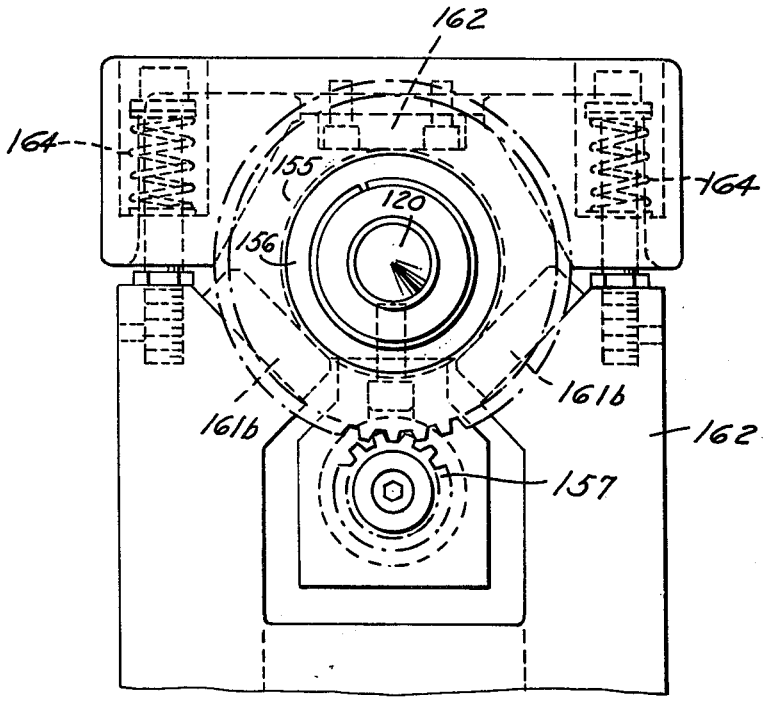
FIG. 21 is an end view taken along the line 21—21 of FIG. 20.

With reference to FIGS. 19, 21 and 21, rotation of the workpiece shaft for gauging and high point positioning purposes is effected by gearing generally indicated at 131 with a suitable two jaw spline or pin drive connection, not shown, to a portion of the workpiece "W" such as flange 132.

With reference to FIGS. 19 and 25–27 showing one of the gauges in enlarged detail it will be seen that a gauge head 122 is urged against the workpiece "W" by a spring 133 reacting against the fixed bushing bracket 134 and a collar 135 secured to the gauge head 122. The lower end of the gauge head 122 has a stem 136 for variable displacement of the core 137 within the transducer coil 138 adjustable by suitable means to a null balance position when the gauge head 122 is at a nominally correct position relative to the workpiece "W" gauge surface.

Figure 24:
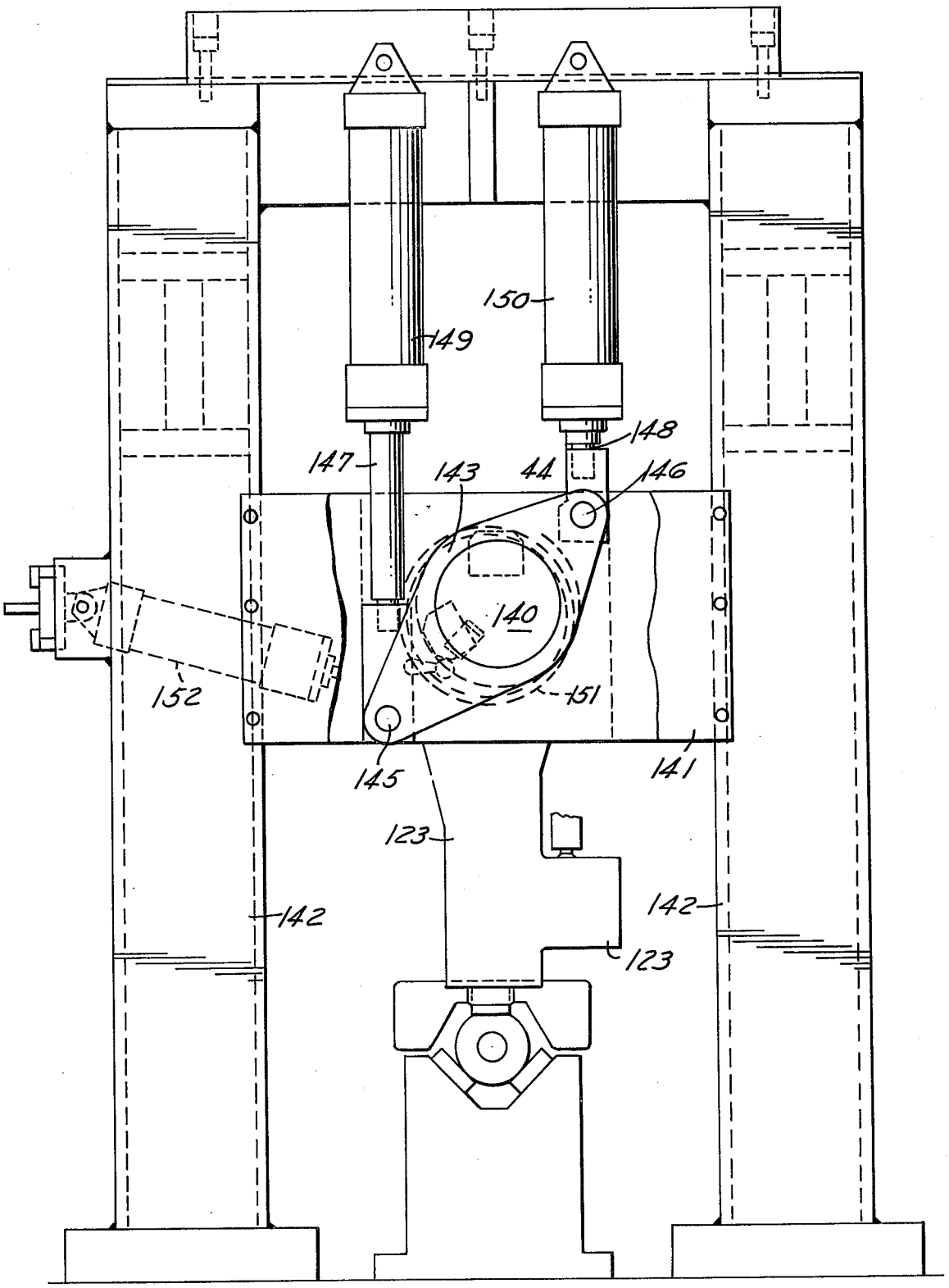
FIG. 24 is an end elevation of the shaft straightening machine illustrated in FIG. 19 including the actuating mechanism for the rams.
Figure 26:
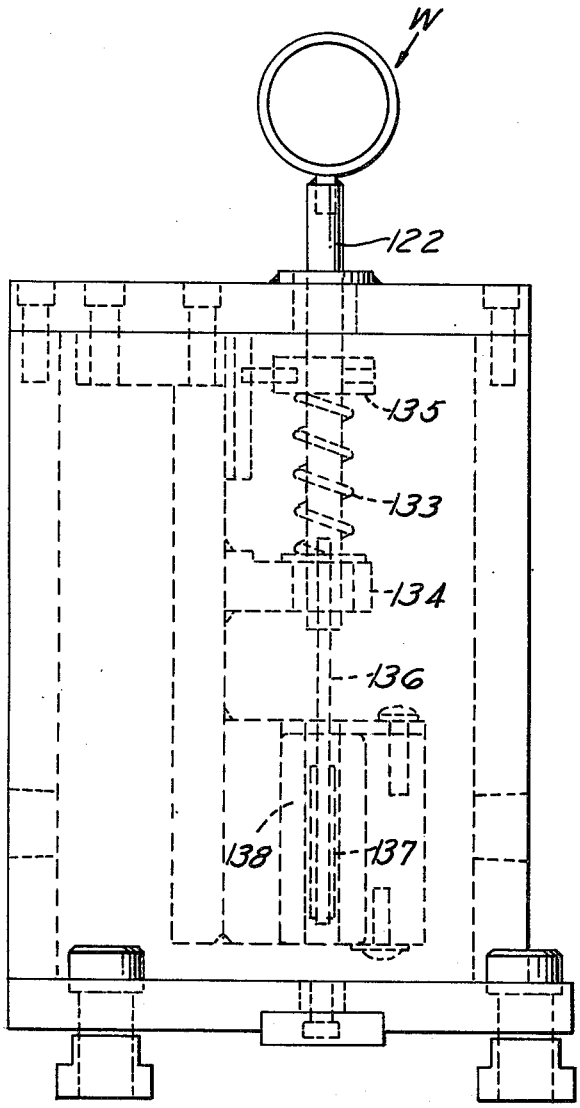
FIG. 26 is an end elevation of such gauge.
Figure 25:
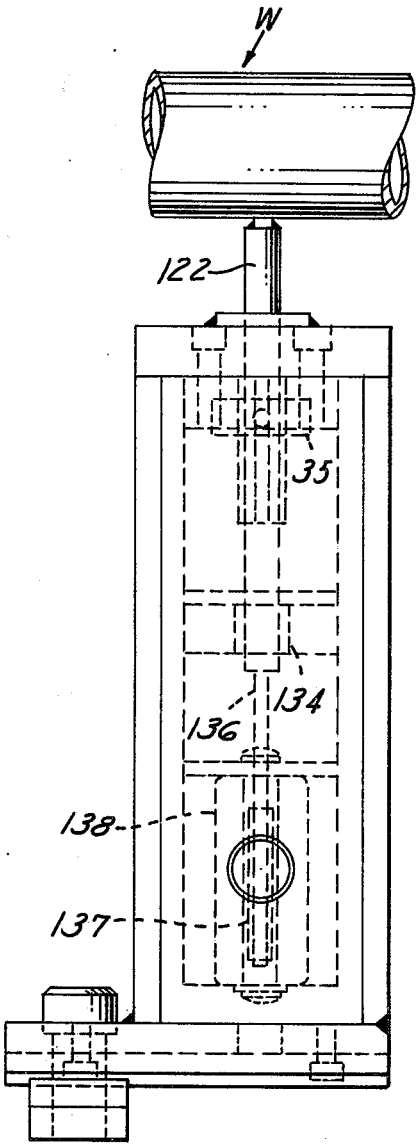
FIG. 25 is an enlarged view of one of the gauges illustrated in FIG. 19.
Figure 27:
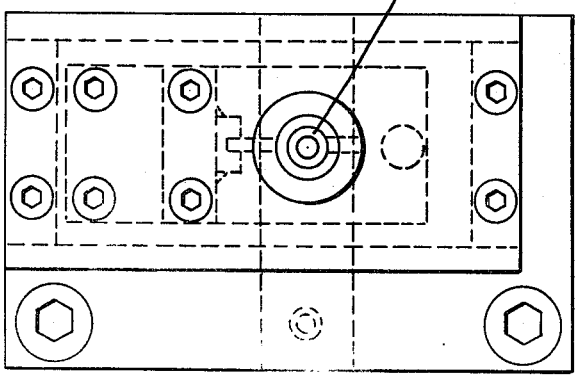
FIG. 27 is a plan view of such gauge.

With reference to FIG. 24 an actuating shaft 140 is mounted at either end through an eccentric ring 143 pinned thereto journaled in a bearing 151 for rotation in a transverse plate 141 secured to frame members 142. A rocker plate 144 secured to the shaft 140 and eccentric ring 143 having extensions pivotally connected respectively at points 145, 146 to a pair of piston rods 147, 148 is actuated under reversible controls by hydraulic cylinders 149 and 150 in opposite linear directions in order to rotate the eccentric ring 143 and shaft 140 between an uppermost position of the shaft as illustrated and a lowermost position effected by reversing the piston rods to move the eccentric through approximately 90° arcuate travel. The head of each ram 123 is pivotally mounted on the shaft 140 between adjustable collars, not shown, and can swing to a clearance position for loading and unloading the workpiece W, as well as to an inactive operating position, through hydraulic actuating cylinder 152.

The rams may be operated individually through a required stroke by controlling the actuation of cylinders 149 and 150 for the operative ram 123 while the other rams are retracted by their respective cylinders 152. Optionally when simultaneous operation of two or more rams 123 is desired, the effective stroke of the individual rams may be adjusted, preferably automatically during retraction, by employing screw threaded workpiece engagement pads 123*x*, 123*y* and 123*z* for the respective ram heads each having an adjustment drive, such as an electric motor driven gear set 123*d* controlled in accordance with programmed requirements responsive to gauged distortion readings of the respective gauge transducers 130*a*, 130*b* and 130*c*.

Figure 20:
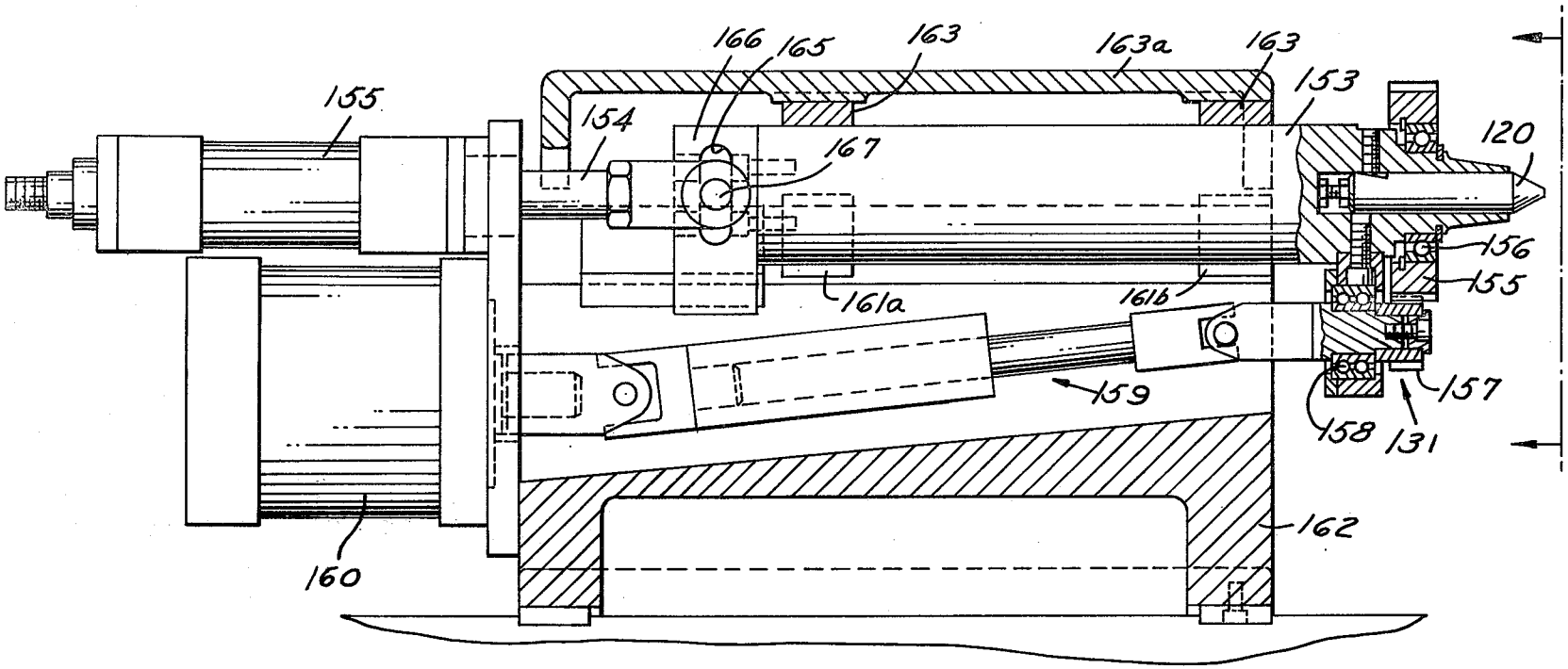
FIG. 20 is an enlarged sectional view of the left hand shaft positioning center and rotating mechanism shown in FIG. 19.

With reference to FIG. 20, the dead center 120 for engaging the flange end of the axle shaft workpiece "W" as shown in FIG. 19 is mounted in the nose of a shaft 153 axially reciprocable through a piston rod 154 and hydraulic cylinder 155 for engagement and disengagement with a center of the workpiece. Gearing 131 including a spur gear 155 mounted on a bearing 156 on the nose of shaft 153 in a pinion gear 157 supported by bearing 158 rotatable through a universal telescoping coupling 159 driven by hydraulic motor 160 provides means for rotating the workpiece during gauging and high point positioning as previously described.

With reference to FIGS. 20 and 21 the shaft 153 is normally located on "V" blocks 161*a*, 161*b* secured to fixed housing 162 and is resiliently held on such V blocks by pads 163 secured to a cover 163*a* which may, if necessary, be lightly spring loaded as indicated at 164 to urge the pads 163 against the top surface of the shaft 153. Downward deflection of the dead center 120 under ram pressure on the workpiece "W" is accommodated by a slot 165 in a tailpiece bracket 166 serving to connect the cross pin 167 of the piston 154 used for axial drive connection so that the rear end of the shaft 153 may deflect upwardly off of V blocks 161*a* while pivoting on the forward V blocks 161*b*. Upon completion of any ram stroke the shaft 153 will return to its fully located position on V blocks 161*a* and 161*b* under the weight of cover 163*a* and any spring loading which may be employed. This is a highly important feature in assuring accurate gauging since the dead center 120 is positively located in exactly the same position by the fixed V blocks 161*a* and 161*b* before and after each ram stroke eliminating any bearing run out or off center inaccuracies associated with live centers such as previously used.

Figure 22:
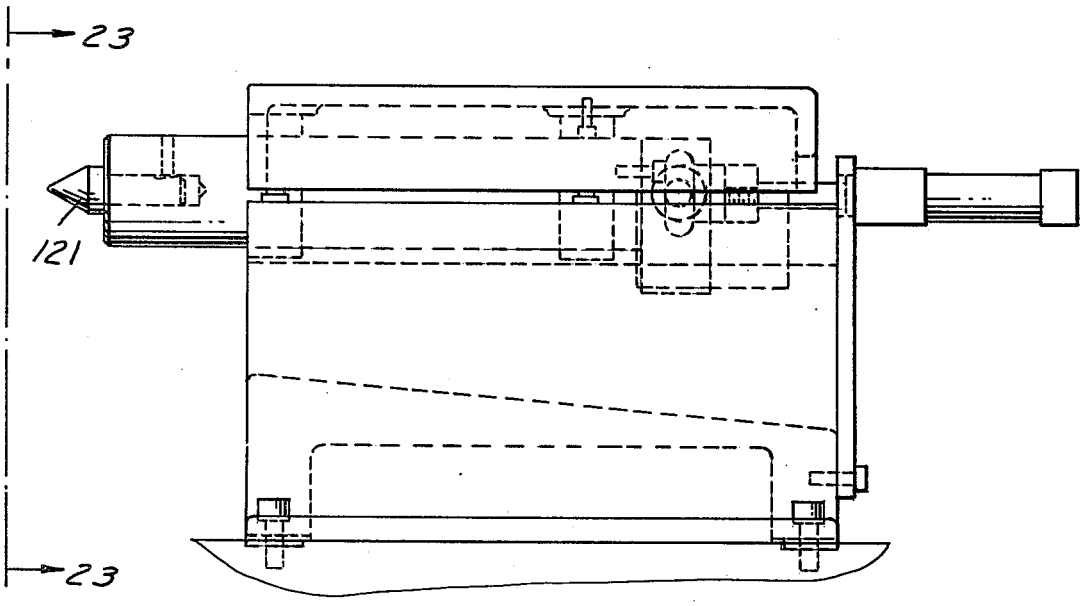
FIG. 22 is an enlarged side elevation of the right hand workpiece center shown in FIG. 19.
Figure 23:
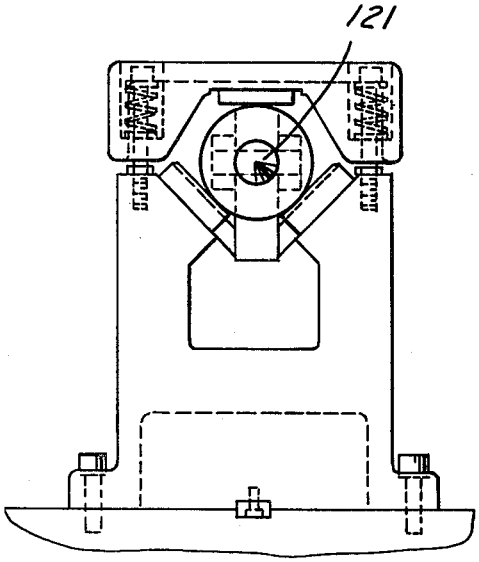
FIG. 23 is an end view taken along the line 23—23 of FIG. 22.

With reference to FIGS. 22 and 23 an identical mounting for the tail stock center 121 is employed except for the omission of drive motor and gearing used only at one driving end.

CONTROL SYSTEM

As mentioned in the introductory BACKGROUND description, prior U.S. Pat. No. 3,474,650 disclosed in detail a control system for straightening a shaft by rotating the high point into the plane of the ram stroke at a single location and actuating the ram with fixed increments in successive strokes until straightening within tolerance was indicated by a gauge adapted to monitor deflection of the shaft and through a voltage signal proportional to deflection produced by a gauge responsive transducer. Such signal compared with voltages established by a series of stepped resistances associated with a stepping relay controlled the stroke of the hydraulically actuated ram.

The present control system as applied to shaft straightening is an improvement over such prior system in the following respects: Instead of employing three circumferentially spaced gauge probes coupled to voltage signal transducers to determine the existence and plane of distortion for purposes of rotating the shaft high point to an upward position, the present control system employs a single gauge probe coupled to a transducer for producing a plus or minus analog voltage signal proportional to deflection; amplifying; converting and storing high and low plus or minus values in a digital controller; comparing such values to determine the magnitude of distortion independently of part size tolerance variations in diameter; using one of the stored maximum displacement values to position the high point of eccentricity in the plane of the ram stroke during a second revolution of the shaft; and using the stored magnitude of distortion data to produce initial and any subsequent programmed ram strokes which reflect and vary with the magnitude of distortion. The program for producing a deflection stroke varying with gauged distortion is based on the general requirement for a greater deflection beyond the neutral axis to straighten a part with greater initial distortion. Thus, by applying, in addition to a standard deflection beyond the neutral axis based on the initial yield point of a straight part, a ratio of gauged distortion as a factor in establishing the deflection stroke and determining such ratio empirically by testing samples of varying distortion magnitude, a program directed to straighten parts of varying distortion with a single deflection stroke has been provided.

In implementing the control system standard commercially available transducers, amplifier and electronic digital controller are employed; for example, an Allen Bradley PLC controller having the capability of receiving an amplified analog transducer plus or minus voltage signal and converting it to storable programmable digital values.

As a specific example the transducers 130*a* and 130*b* illustrated in FIG. 19 can be adjusted to produce plus or minus ten volt values in response to one-tenth inch gauge displacement from a neutral null balance position. The controller may likewise be adjusted for digital values ranging from 0 to 999 with zero volts of the transducer equal to a neutral 500. For the center transducer 130*c*, a plus or minus one-fourth inch core stroke may be employed to allow for greater amplitude of deflection.

The controller is capable of receiving a variable amplified analog voltage signal from the transducer during an initial gauging revolution of the workpiece shaft and storing maximum signal values received during such revolution; for example, a distorted shaft might produce a high value of 700 and a low value of 300 with the 400 difference indicating distortion and the 700 identifying the high point of the shaft in the plane of maximum distortion. For the second revolution the program may call for rotation to stop at a value 698 or 699 to allow for inertia from speed of rotation.

The programmed initial deflection, as applied for example to ram 123*a* with a control responsive to 122*a* shown in FIG. 19, with include allowance for initial deflection to reach the reaction anvil 124 (e.g. 0.020") and additional deflection based on a standard minimum yield point value for a straight workpiece, plus a ratio of gauged distortion based on experience, which could be more or less than 100%.

One or more successive repeat strokes, if required, may be based on the same ratio of regauged remaining distortion, or such other variable as experience recommends, or in some cases with added fixed increments after an initial insufficient straightening deflection.

The sequential steps of loading, gauging, straightening, regauging, restraightening, if necessary, confirming tolerance requirements and unloading the workpiece are electronically controlled utilizing conventional hydraulic and electromechanical elements as required. The number as well as magnitude of straightening steps without reaching tolerance may be programmed and limited (without the need for previously employed mechanical stepping relay) so as to reject the part after a given number of straightening trys.

It is contemplated that a step for hardness testing of the workpiece may be included at the straightening location and in the program so that a relatively higher deflection stroke will result from a relatively higher hardness value commensurate with the greater resiliency and spring back. By such means together with adjustment of the program with experience an ever closer approach can be made to consistent straightening within tolerance with a single or minimum number of ram strokes.

In the case of the axle shaft illustrated in FIG. 19 there are optional approaches for straightening with sequential ram deflections or with all three rams deflecting at once. In the former case a preferred order would be to gauge at 122*a* and deflect with ram 123*a* with anvil 126 in operative position thus bending the part between anvils 124 and 126 followed by gauging at 122*b* deflection by ram 123*b* between reaction anvils 126 and 128 and finally gauging at 122*c* and deflecting with ram 123*c* with anvil 126 removed thus bending between fixed anvils 124 and 128.

In carrying out the other optional approach, preferably limited to shafts which are generally distorted with a single bow rather than an "S" or irregular type of distortion, information from all three gauges 122*a*, 122*b* and 122*c* may be included in the program followed by programmed adjustment of the individual ram pads 123*x*, 123*y* and 123*z* and a simultaneous actuation of all three rams 124*a*, 123*b* and 123*c* with the center anvil 126 moved to an inoperative position. With reference to FIG. 24, since the eccentrics 143 will produce a uniform vertical stroke for the actuating shaft 140 and all rams connected thereto, adjustment of the effective stroke for the individual rams relative to each other will be accomplished by the relative position of respective adjustable ram pads engaging the workpiece at variable portions of each ram stroke.

As applied to knuckle straightening the controller program will of course be modified to actuate a given ram stroke in either of two opposite directions depending on the gauged distortion; and the program will use a single distortion value (plus or minus from a neutral reference of a straight master part) to determine the magnitude of straightening deflection stroke. In other respects, however, the objectives and system for achieving corrective straightening of a given distortion in a given plane with a single ram stroke through employment of a variable program responsive to gauged distortion are similar to their application to rotatable shafts or irregular workpieces.

The general aspects of the system with respect to operations and equipment are shown in FIG. 28 while the variations incident to applying the system to shafts and irregular workpieces are illustrated in FIGS. 29 and 30, respectively.

I claim:

1. A system for straightening production quantities of a workpiece comprising;
- a straightening machine having a fixed frame,
- means for positioning said workpiece in precise orientation relative to said frame,
- automatic means for gauging the magnitude of any distortion in said workpiece which may require correction,
- automatic power operated means for deflecting said workpiece beyond yield point in a plane and direction required for correction of said distortion,
- said means for deflecting having a controllable stroke potentially sufficient to eliminate said distortion in said plane within production tolerance requirements in a single deflection of required magnitude followed by springback,
- and control means including,
- means for storing gauged data relative to the magnitude of distortion, and
- programmable means for controlling the stroke of said means for deflecting to produce programmed correction deflection of a magnitude varying with and responsive to the magnitude of gauged distortion.

2. A system for workpiece straightening as set forth in claim 1 wherein said programmable means include means for combining the magnitude of a predetermined deflection based on the yield point of a workpiece having no distortion in the plane of correction with an additional value of deflection based on a programmed ratio of gauged distortion in said plane of correction to provide a total initial deflection stroke value directed to result in a single stroke correction within tolerance without overbending.

3. A system for workpiece straightening as set forth in claim 1 wherein said programmable means includes means for sub-program storage for regauging and redeflecting when tolerance is not reached in the initial deflection stroke.

4. A system for a workpiece straightening as set forth in claim 1 wherein said means for gauging and control means include variable transducer means adapted to produce a voltage signal changing in value with gauge displacement, signal amplifying means, and digital controller means.

5. A system for workpiece straightening as set forth in claim 4 and means adapting said variable transducer means to monitor the limit of said corrective deflection as well as to provide initial distortion data.

6. A system for workpiece straightening as set forth in claim 1 wherein said workpiece has a plurality of potential distortions requiring correction, separate means for gauging and deflecting for each potential distortion, said control means including means for storing each gauged distortion and separate program for each required initial correction stroke, and means for controlling the sequence of required straightening operations.

7. A system for workpiece straightening as set forth in claim 1 including hydraulically actuated means for rapidly deflecting said workpiece to a predetermined minimum common to all comparable initial straightening operations, and means for more gradually completing said initial deflection stroke in accordance with the gauge responsive program.

8. A system as set forth in claim 1 applied to straightening an elongated workpiece relative to a central axis, including means for mounting said workpiece for gaugable rotation about said axis, and automatic means for gauging the plane and magnitude of maximum distortion at a critical location in the length of said workpiece.

9. A system as set forth in claim 8 including means for gauging the plane and magnitude of maximum distortion at each of a plurality of critical locations in the length of said workpiece, automatic power operated means for deflecting said workpiece in the plane of maximum distortion at each of said critical locations to produce corrective workpiece deflection beyond yield point in said plane.

10. A system for workpiece straightening as set forth in claim 8 including controllable means for rotating said workpiece to any circumferential positions,
- said means for gauging including a single displaceable probe engageable with said critical location during a single revolution adapted to produce a voltage signal varying in magnitude with displacement,
- said control means including digital controller means adapted,
- to store high and low values of said voltage signal,
- to determine the magnitude of distortion by the difference in said high and low values,
- to use one of said values to control the positioning of said workpiece in the plane of maximum distortion in alignment with the operating plane of said means for deflecting,
- to initiate said straightening, and
- to terminate said stroke in response to deflection displacement of said variable transducer means in accordance with said program.

11. A system for workpiece straightening as set forth in claim 1 for a workpiece having a main body and an extension with a potential distortion,
- means for rigidly clamping said main body in fixed precise orientation relative to said frame,
- said means for gauging including means for indicating the direction as well as the magnitude of said extension distortion, said means for deflecting including means to produce workpiece extension deflection beyond yield in the plane of and in a direction opposite to said gauged distortion while said main body remains rigidly clamped.

12. A system for workpiece straightening as set forth in claim 1 for a workpiece having a main body and a plurality of potential extension distortions in a plurality of difference planes, means for rigidly clamping said main body in fixed precise orientation relative to said frame, automatic means for gauging the direction and magnitude of each of said extension distortions in each of said planes, automatic power operated workpiece extension deflection means for each of said extension distortions adapted to produce workpiece extension deflection beyond yield in the plane of and in a direction opposite to said gauged distortion while said main body remains rigidly clamped.

13. A system for workpiece straightening as set forth in claim 12 wherein said means for gauging and means for deflecting a plurality of extension distortions are provided at a single clamping station.

14. A system for workpiece straightening as set forth in claim 12 wherein said straightening machine includes a plurality of successive clamping stations, and said means for gauging and means for deflecting are provided at succeeding clamping stations.

15. A system for workpiece straightening as set forth in claim 14 wherein said straightening machine includes a loading station, and means for transferring successive workpieces from said loading station to said successive clamping stations and following all straightening operations back to said loading station.

16. A system as set forth in claim 12 for straightening a steering knuckle workpiece having separate arms each potentially requiring straightening in either direction in either of two separate planes.

17. A system as set forth in claim 12 for straightening a steering knuckle workpiece having separate arms each potentially requiring straightening in either direction in either of two separate planes, said straightening machine including means for straightening said separate arms at a single clamping station.

18. A system as set forth in claim 12 for straightening a steering knuckle workpiece having separate arms each potentially requiring straightening in either direction in either of two separate planes, said straightening machine including means for straightening said separate arms at a single clamping station, and said machine including an additional clamping station for straightening an additional arm.

19. A system for elongated workpiece straightening as set forth in claim 8 including dead center means for mounting the workpiece during gauging, positioning and regauging operations.

20. A system for elongated workpiece straightening as set forth in claim 8 including dead center means for mounting the workpiece during gauging, positioning and regauging operations, means for accurately locating said dead center means on fixed surfaces during gauging operations, and means permitting said dead centers to yield to an anvil supporting position of the workpiece during ram deflection operations.

21. A system for elongated workpiece straightening as set forth in claim 9 including a common shaft for mounting a plurality of rams and eccentric means for mounting said shaft on the fixed frame of the machine whereby rotation of said eccentric means will produce ram actuating displacement of said shaft.

22. A system as set forth in claim 21 including means for selectively retracting a ram from its operative position.

23. A system as set forth in claim 21 including means for adjusting the effective length of individual rams to thereby adjust their relative effective strokes and combined deflection effect.

24. A system for workpiece straightening as set forth in claim 1 including means for storing gauged data relative to the hardness of the workpiece for use in increasing the programmed deflection stroke with increasing hardness.

* * * * *

Disclaimer 4,144,730.—*Edward E. Judge, Jr.*, Lansing, Mich. PRODUCTION WORK-PIECE STRAIGHTENING SYSTEM. Patent dated Mar. 20, 1979. Disclaimer filed Oct. 17, 1979, by the assignee, *Industrial Metal Products Corp.*

Hereby enters this disclaimer to claims 13, 17 and 18 of said patent.

[*Official Gazette September 28, 1982.*]